US010067440B2

(12) United States Patent
Miyadera

(10) Patent No.: US 10,067,440 B2
(45) Date of Patent: Sep. 4, 2018

(54) WRITE CONTROL APPARATUS, IMAGE FORMING APPARATUS, WRITE CONTROL METHOD AND RECORDING MEDIUM

(71) Applicant: Tatsuya Miyadera, Kanagawa (JP)

(72) Inventor: Tatsuya Miyadera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 24 days.

(21) Appl. No.: 14/851,591

(22) Filed: Sep. 11, 2015

(65) Prior Publication Data

US 2016/0077459 A1 Mar. 17, 2016

(30) Foreign Application Priority Data

Sep. 17, 2014 (JP) ..... 2014-189011

(51) Int. Cl.
*G06F 15/00* (2006.01)
*G03G 15/043* (2006.01)

(52) U.S. Cl.
CPC ..... *G03G 15/043* (2013.01)

(58) Field of Classification Search
CPC ..... G03G 15/043
USPC ..... 358/1.16
See application file for complete search history.

(56) References Cited

U.S. PATENT DOCUMENTS 7,715,769 B2 5/2010 Miyadera
7,805,100 B2 9/2010 Miyadera
7,986,907 B2 7/2011 Miyadera
8,004,546 B2 8/2011 Miyadera
8,026,937 B2 9/2011 Miyadera
8,035,667 B2 10/2011 Miyadera
8,170,455 B2 5/2012 Miyadera
8,369,725 B2 2/2013 Ohshima et al.
(Continued)

FOREIGN PATENT DOCUMENTS

JP 2006-259360 9/2006

OTHER PUBLICATIONS

Machine translation of Japanese Patent Document No. 2006-259360, Omiya, Sep. 28, 2006.*
(Continued)

*Primary Examiner* — Mark R Milia
(74) *Attorney, Agent, or Firm* — Oblon, McClelland, Maier & Neustadt, L.L.P.

(57) ABSTRACT

A write-control apparatus for receiving one page worth of image data, applying processes, and writing an image by exposing a photoconductor according to the processes-applied image data is provided. The write-control apparatus includes a write-control unit for including different process-function units for applying the processes; a control unit for generating setting values of parameters used by the process-function units; and a first storage for storing the generated setting values of the parameters. The write-control unit generates a second timing signal which asserts earlier than a first timing signal which starts writing the image by operating the process-function units, a second storage stores the one page worth of the setting values stored in the first storage according to an assert timing of the second timing signal, and the setting values stored in the second storage are reflected in operations of the process-function units for writing the image of the page.

15 Claims, 15 Drawing Sheets

(56) References Cited

U.S. PATENT DOCUMENTS

| | | | |
|---|---|---|---|
| 8,488,201 | B2 | 7/2013 | Miyadera et al. |
| 8,600,283 | B2 | 12/2013 | Kinoshita et al. |
| 8,638,481 | B2 | 1/2014 | Miyadera et al. |
| 8,654,419 | B2 | 2/2014 | Miyazaki et al. |
| 8,659,630 | B2 | 2/2014 | Komai et al. |
| 8,665,299 | B2 | 3/2014 | Miyadera et al. |
| 8,681,390 | B2 | 3/2014 | Takahashi et al. |
| 8,712,310 | B2 | 4/2014 | Shimizu et al. |
| 8,730,288 | B2 | 5/2014 | Miyadera |
| 8,744,293 | B2 | 6/2014 | Shirasaki et al. |
| 8,774,700 | B2 | 7/2014 | Shikama et al. |
| 8,781,343 | B2 | 7/2014 | Hayashi et al. |
| 8,823,760 | B2 | 9/2014 | Miyadera |
| 8,848,238 | B2 | 9/2014 | Miyadera et al. |
| 8,878,885 | B2 | 11/2014 | Miyadera |
| 8,879,969 | B2 | 11/2014 | Shikama et al. |
| 8,885,213 | B2 | 11/2014 | Yokoyama et al. |
| 8,917,303 | B2 | 12/2014 | Miyadera |
| 8,957,933 | B2 | 2/2015 | Shirasaki et al. |
| 9,013,532 | B2 | 4/2015 | Komai et al. |
| 9,019,551 | B2 | 4/2015 | Hayashi et al. |
| 9,036,198 | B2 | 5/2015 | Miyadera et al. |
| 9,041,756 | B2 | 5/2015 | Miyadera |
| 9,104,127 | B2 | 8/2015 | Yamaguchi et al. |
| 9,106,861 | B2 | 8/2015 | Miyadera et al. |
| 2010/0119273 | A1 | 5/2010 | Komai et al. |
| 2010/0239331 | A1 | 9/2010 | Miyadera et al. |
| 2012/0057889 | A1 | 3/2012 | Yamaguchi et al. |
| 2012/0069402 | A1* | 3/2012 | Konno ..... G06K 15/1896 358/1.16 |
| 2013/0004194 | A1 | 1/2013 | Shirasaki et al. |
| 2013/0044176 | A1 | 2/2013 | Shirasaki et al. |
| 2013/0207339 | A1 | 8/2013 | Yokoyama et al. |
| 2013/0242318 | A1 | 9/2013 | Yamaguchi et al. |
| 2014/0078521 | A1 | 3/2014 | Hayashi et al. |
| 2014/0139607 | A1 | 5/2014 | Hayashi et al. |
| 2014/0152754 | A1 | 6/2014 | Murakami et al. |
| 2014/0153042 | A1 | 6/2014 | Kawanabe et al. |
| 2014/0153943 | A1 | 6/2014 | Miyadera et al. |
| 2015/0139702 | A1 | 5/2015 | Murakami et al. |

OTHER PUBLICATIONS

U.S. Appl. No. 14/853,076, filed Sep. 14, 2015.
U.S. Appl. No. 14/632,188, filed Feb. 26, 2015.
U.S. Appl. No. 14/797,927, filed Jul. 13, 2015.
U.S. Appl. No. 14/853,076, filed Sep. 14, 2015, Miyadera.

* cited by examiner

FIG.4

| LATCH TIMING | REFLECTION TIMING | ON/OFF | TARGET REGISTER |
|---|---|---|---|
| LATCH AT MFSYNC (IMFSYNC) ASSERT TIMING | REFLECT AT CORRESPONDING PAGE MFSYNC (IMFSYNC) ASSERT TIMING | ON/OFF ENABLED | SUB-SCANNING COUNTER INITIAL VALUE SETTING REGISTER |
| | | | |
| | | | |
| | | | |
| | | | |
| | | | |
| | | | |
| | | | |

FIG.6

| LATCH TIMING | REFLECTION TIMING | ON/OFF | TARGET REGISTER |
|---|---|---|---|
| LATCH AT FLOAD ASSERT TIMING | REFLECT AT CORRESPONDING PAGE FLOAD ASSERT TIMING | ON/OFF ENABLED | TRANSFER IMAGE SIZE (MAIN SCANNING) SETTING REGISTER |
| | | | TRANSFER IMAGE SIZE (SUB-SCANNING) SETTING REGISTER |
| | | | INPUT IMAGE RESOLUTION SETTING REGISTER |
| | | | INPUT IMAGE DOUBLE DENSITY PROCESS (MAIN SCANNING) SETTING REGISTER |
| | | | INPUT IMAGE DOUBLE DENSITY PROCESS (SUB-SCANNING) SETTING REGISTER |
| | | | OUTPUT IMAGE RESOLUTION SETTING REGISTER |
| | | | OUTPUT IMAGE MAIN SCANNING START POSITION SETTING REGISTER |
| | | | OUTPUT IMAGE MAIN SCANNING WIDTH SETTING REGISTER |
| | | | SUB-SCANNING COUNTER ENDING DELAY SETTING REGISTER |
| | | | AREA GRADATION CORRECTION SETTING REGISTER |

FIG.10

| LATCH TIMING | REFLECTION TIMING | ON/OFF | TARGET REGISTER |
|---|---|---|---|
| LATCH AT LTSYNC ASSERT TIMING | REFLECT AT CORRESPONDING PAGE LTSYNC ASSERT TIMING | ON/OFF ENABLED | REGISTER OF PARAMETER USED BY MULTIPLE FUNCTION UNITS |
| | | | REGISTER OF PARAMETER USED BY IMAGE PROCESS UNIT |
| | | | REGISTER OF PARAMETER USED BY SKEW CORRECTION UNIT |
| | | | REGISTER OF PARAMETER USED BY SERIAL CONVERSION UNIT |
| | | | REGISTER OF PARAMETER USED BY ARRAY CONVERSION UNIT |
| | | | REGISTER OF PARAMETER USED BY GRADATION CONVERSION UNIT |
| | | | REGISTER OF PARAMETER USED BY PIXEL COUNT UNIT |
| | | | REGISTER OF TRANSMISSION SIGNAL TO FUNCTION UNIT USED BY OTHER THAN PLOTTER CONTROL UNIT |
| | | | REGISTER OF REGISTER GROUP SWITCHING SIGNAL TO FUNCTION UNIT USING DOUBLE REGISTER |

FIG.14

| LATCH TIMING | REFLECTION TIMING | ON/OFF | TARGET REGISTER |
|---|---|---|---|
| LATCH AT ADJUSTMENT PATTERN FGATE ASSERT TIMING | REFLECT AT CORRESPONDING PATTERN ADJUSTMENT PATTERN FGATE ASSERT TIMING | ON/OFF ENABLED | REGISTER OF ADJUSTMENT PATTERN CONTROL USED BY PIXEL COUNT UNIT |
| | | | REGISTER OF ADJUSTMENT PATTERN CONTROL USED BY GRADATION CONVERSION UNIT |
| | | | |
| | | | |
| | | | |
| | | | |
| | | | |
| | | | |

WRITE CONTROL APPARATUS, IMAGE FORMING APPARATUS, WRITE CONTROL METHOD AND RECORDING MEDIUM

BACKGROUND OF THE INVENTION

1. Field of the Invention

The present invention generally relates to a write control apparatus and an image forming apparatus therewith, a write control method and a recording medium.

2. Description of the Related Art

As an image forming apparatus including a printer, a copier, a facsimile machine, and a multifunction peripheral which has multiple functions thereof, an electrophotography type image forming apparatus is often used. In this type of image forming apparatus, in the case where images are continuously formed on multiple pages, productivity is increased by making a space between transfer papers (between-papers distance) as short as possible in order to speed up the image forming process.

Most of today's electrophotography type image forming apparatuses are digital. Digitized image data is processed by a write control apparatus and an exposure apparatus which has a light source such as a laser diode is operated. According to the exposure apparatus, a latent image is formed on a surface of a charged photoconductor by light writing. The electrostatic latent image is developed with toner. The toner image is directly, or via an intermediate transfer member, transferred onto a recording medium such as a transfer paper. The transferred image is fixed on the recording medium by a fixing device.

In this type of image forming apparatus, in the case where images are continuously formed on multiple pages using various sizes of transfer papers and using various image formation modes, parameters corresponding to image formation conditions, etc., must be set for each page in a write control unit.

In a tandem image forming apparatus used for a color image forming apparatus, in a function of setting parameters in a write control unit from an engine unit controlling CPU, in order to update the parameters between pages (between-pages period), a high processing speed is required. In order to achieve the high speed processing speed, a parameter control technique is known in which two sets of multiple parameters are respectively set in two sets of registers and only a register selection signal is switched between the pages (double register system).

For example, Patent Document 1 discloses that, in a write control apparatus for writing image information onto paper, a storage unit for setting various parameters necessary for write control and a plurality of storage unit groups (registers) are provided, and the storage unit groups are switched according to print modes.

The parameter setting according to the above-described conventional double register system will be briefly described referring to FIG. 15.

In the system, registers a and registers b which have an equivalent function are prepared. Further, for example, in (example 1) of FIG. 15, parameters for A4 size copy are set in the registers a, and parameters for A3 size copy are set in the registers b. In (example 2), parameters for A4 size copy are set in the registers a, and parameters for A4 size printer are set in the registers b.

Arrows in FIG. 15 indicate a direction of transfer paper flow (sub-scanning direction). Further, "copy" means an image formation mode for performing writing using image data read by a scanner from an original image, and "printer" means an image formation mode for performing writing using print data created by an external apparatus such as a personal computer.

Further, just before forming an image of a page whose page size or image formation mode is different, by controlling only a switching register which switches between the registers a and the registers b, registers to be reflected in the image formation can be instantly selected.

For example, in (example 2) of FIG. 15, during an image formation of A4-printer in which parameters set in the registers b are reflected, parameters for A4-copy are set in the registers a. Then, just before the start of image formation of A4-copy, by setting the switching register to the registers a, an image formation of A4-copy in which parameters set in the registers a are reflected can be started.

In this kind of double register system, addresses of the registers a and the registers b are alternated.

In this kind of double register system, in the case of a fatal error, it may become indefinite which of the registers a and the registers b are effective registers. As a result, at the time of a fatal error, the switching register must be immediately updated to set one of the registers and the system should restart.

In the parameter control technique according to this kind of conventional double register system, a timing of setting the selection signal needs to be between pages. As a result, a process for monitoring a between-pages timing is needed. In the monitoring process, an active signal which indicates an image formation period and an interrupt signal which indicates an end of the image formation are detected by a CPU.

In this monitoring process, the timing of detecting the active signal or the interrupt signal is not exactly the same as the timing of starting or ending of the use of various setting values in the write control unit. Therefore, the exact timing of setting parameters availability is unknown. As a result, the setting parameters availability time becomes shorter than the between-pages period, and in order to secure the setting parameters availability period, the between-pages distance needs to be extended, thereby productivity of the image forming apparatus is lowered, which is a problem.

In order to solve the above problem, the present invention provides a write control apparatus of an image forming apparatus in which write control apparatus, timings of storing and reflecting parameter setting values can be automatically and optimally adjusted, and speedy and secure parameter setting for each image formation page is realized with a simple system while maintaining the productivity.

CITATION LIST

Patent Document

[Patent Document 1] Japanese Laid-Open Patent Application No. 2006-259360

SUMMARY OF THE INVENTION

In order to solve the above problem, the present invention provides a write control apparatus for receiving one page worth of image data, performing various processes for the received image data, controlling an exposure means according to the various processes performed on the image data, and performing image writing by exposing a photoconductor. The write control apparatus includes a write control unit configured to have a plurality of different process-function units for performing the various processes, an arithmetic control means configured to create setting values of various parameters used by the plurality of different process-function units and at the same time control the write control unit, a first storage means configured to store the setting values of the various parameters created by the arithmetic control means, and a second storage means configured to store one page worth of the setting values of the various parameters stored in the first storage means. Further, the write control unit includes a timing signal creating means configured to create a second timing signal which asserts earlier than a first timing signal which starts writing the image by operating the process-function units, and the second storage means, by the assertion of the second timing signal, stores one page worth of the setting values stored in the first storage means, and the setting values are reflected by the write control unit for operations of the process-function units for writing the image of the page.

ADVANTAGEOUS EFFECTS OF INVENTION

In the write control apparatus according to the present invention, timings of storing and reflecting parameter setting values can be automatically and optimally adjusted, and speedy and secure parameter settings for each image formation page are realized with a simple system while maintaining the productivity.

BRIEF DESCRIPTION OF THE DRAWINGS

FIG. 4 is an illustration showing an example of MFSYNC latch parameters.

FIG. 6 is an illustration showing an example of FLOAD latch parameters.

FIG. 10 is an illustration showing an example of LTSYNC latch parameters.

FIG. 14 is an illustration showing an example of adjustment pattern latch parameters.

DESCRIPTION OF THE PREFERRED EMBODIMENTS

In the following, embodiments of the present invention will be specifically described referring to accompanying drawings.

Figure 1:
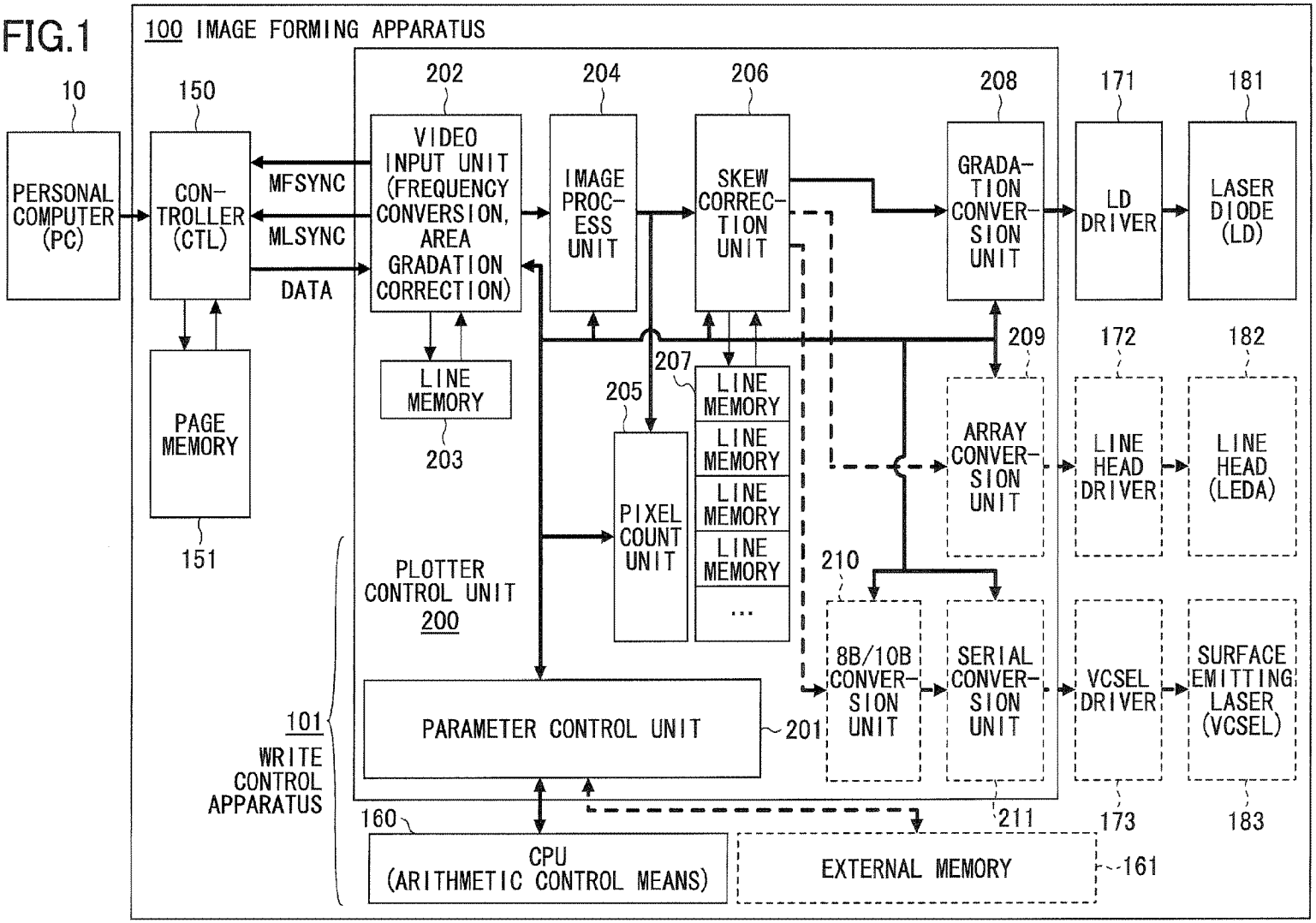
FIG. 1 is a block diagram illustrating an embodiment of an image forming apparatus with a write control apparatus according to the present invention.
Figure 2:
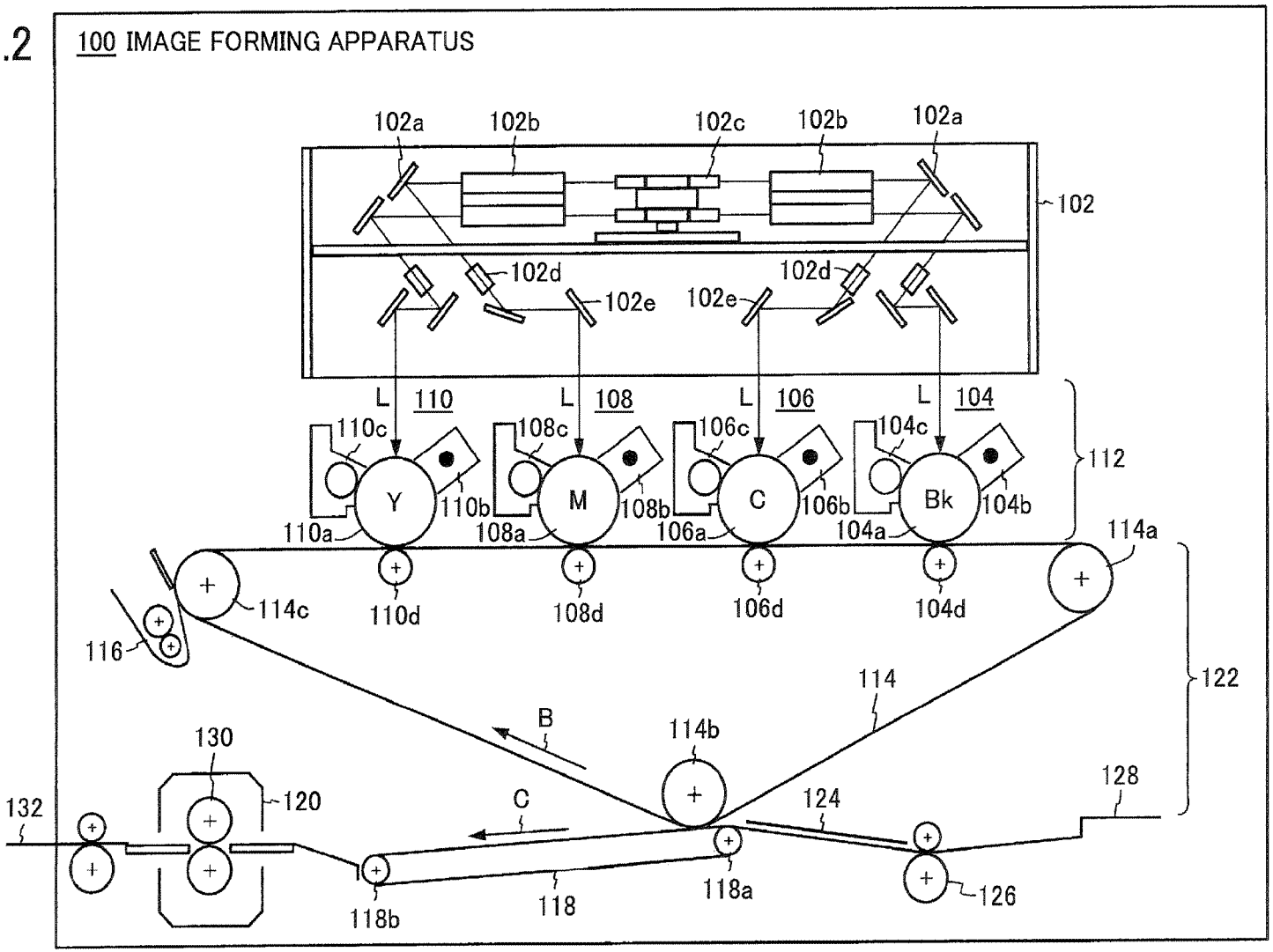
FIG. 2 is a schematic diagram illustrating an example of a mechanism unit included in an engine unit of the image forming apparatus.

FIG. 1 is a block diagram illustrating an embodiment of an image forming apparatus 100 with a write control apparatus according to the present invention. FIG. 2 is a schematic diagram illustrating an example of a mechanism unit included in an engine unit of the image forming apparatus 100.

The image forming apparatus 100 of the present embodiment includes a controller (CTL) 150; a page memory 151; a plotter control unit 200, a CPU 160 shown in FIG. 1, and a mechanism unit shown in FIG. 2 which are included in an engine unit. Also, the image forming apparatus 100 of the present embodiment is included in a tandem digital color copy machine, a digital color multifunction peripheral, a color facsimile machine, a color printer, etc.

[Overview of a Controller and a Write Control Apparatus]

The controller 150 in FIG. 1 receives via a network (not shown) print data created in an external personal computer (hereinafter referred to "PC") and generated by a printer driver installed in the PC. The print data is described in, for example, PDL (Page Description Language). Further, the controller 150 converts the received print data on the page memory 151 into color versions of the image data for each page composed of pixels of each color (e.g., bitmap data) and transfers the image data to the plotter control unit 200 line by line.

The controller 150 includes a microcomputer including a CPU, a ROM, a RAM, etc.

The plotter control unit 200 is a write control unit, and, together with the CPU 160 and even with an external memory 161, is included in a write control apparatus 101 according to the present invention.

The plotter control unit 200 as a write control unit performs various processes for one page worth of image data transferred from the controller 150 by using the plurality of process-function units. Further, by controlling the exposure means according to the processes-performed image data, the plotter control unit 200 writes the image by exposing a photoconductor, which will be described later, by using the exposure means.

In other words, the plotter control unit 200 treats the image data transferred from the controller 150 as emission data. A laser diode (LD) 181 is assumed as a light source of the exposure means, but a line head 182 in which LEDs are arranged in the form of an array (LEDA) or a surface emitting laser (VCSEL) 183 may also be used.

The plotter control unit 200 includes various process-function units such as a video input unit 202, a line memory 203, an image process unit 204, a pixel count unit 205, a skew correction unit 206, a line memory group 207, a gradation conversion unit 208, or the like; and a parameter control unit 201.

Also, instead of, or together with, the gradation conversion unit 208, an array conversion unit 209 for using the line head 182 as the light source, a 8B/10B conversion unit 210 for using the surface emitting laser 183, and a serial conversion unit 211 may also be included. By including all of the above units, the plotter control unit 200 can use any of the laser diode, the line head, and the surface emitting laser as a light source for light writing.

It should be noted that the plotter control unit 200 includes four channels from channel 0 (ch0) through channel 3 (ch3) (not shown), and color versions of the image data transferred from the controller 150 page by page and line by line are input to corresponding channels.

A laser diode 181 and an LD driver 171 for driving the laser diode 181, or a line head 182 and a line head driver 172 for driving the line head 182, or a surface emitting laser 183 and a VCSEL driver 173 for driving the surface emitting laser 183 are provided for each color version corresponding to its channel.

In the present embodiment, it is assumed, but is not limited, that a yellow color version of the image data is input to ch0, a magenta color version is input to ch1, a cyan color version is input to ch2, and a black color version is input to cha3. Yellow, magenta, and cyan are three primary colors for forming a full color image by adding colors, and correspond to toner colors when developing an electrostatic latent image.

In the plotter control unit 200, a parameter control unit 201 is included for storing setting values of various parameters used by the plurality of process-function units, which transfers the setting values to the process-function units. The parameter control unit 201 is connected to and controlled by the external CPU 160, and the stored various parameters can be rewritten. Normally, flip flops (FF) in the parameter control unit 201 are used for storing parameters, but a memory such as an SRAM, a FIFO, or a non-volatile RAM may also be used. The above memory includes areas corresponding to a first storage means and a second storage means which will be described later. Also, the storage area may be expanded by connecting an external memory 161 or the storage area may be optimized for each model.

The CPU 160 is not a CPU as a mere central processing unit, but an arithmetic control means based on a microcomputer including, for example, a ROM as a program memory and a RAM as a data memory. Further, the CPU 160 controls each of the function units in the plotter control unit 200 including the parameter control unit 201 and controls the entire engine unit including a mechanism unit which will be described later referring to FIG. 2.

Therefore, the CPU 160 is connected to all of the function units such as the video input unit 202, the image process unit 204, the pixel count unit 205, the skew correction unit 206, and the gradation conversion unit 208 via the parameter control unit 201.

The plotter control unit 200 and the CPU 160 and even an external memory 161 are included in a write control apparatus 101 according to the present invention.

The CPU 160 as an arithmetic control means creates values of various parameters used by various process-function units in the plotter control unit 200 and controls the entire plotter control unit 200 as well.

The values of the various parameters created by the CPU 160 are stored in the first storage means in the parameter control unit 201 which will be described later.

The second storage means in the parameter control unit 201 which will be described later is capable of storing one page worth of the values of the parameters stored in the first storage means.

The CPU 160 transmits a trigger signal common for all colors indicating a start of image formation to each of the plotter control units 200 for corresponding colors. Then, just before the actual start of image writing of a page, each of the plotter control units 200 causes the second storage means to store one page worth of the setting values of parameters stored in the first storage means of the parameter control unit 201. Each of the plotter control units 200 reflects the one page worth of the setting values stored in the second storage means in operations of various process-function units for writing an image of corresponding color of the page.

When a print operation is instructed by a PC 10, image data are transferred to the controller 150 via a printer driver on the PC 10. The controller 150 converts the image data into bitmap data on the page memory 151, and transfers one page worth of each color of the image data to a video input unit 202 of the plotter control unit 200 for each color.

In the plotter control unit 200, a frame synchronization signal MFSYNC and a line synchronization signal MLSYNC are output to the controller 150 from the video input unit 202. The frame synchronization signal MFSYNC is a pulse type synchronization signal indicating a page tip, and the line synchronization signal MLSYNC is a pulse type synchronization signal indicating a line tip.

After the frame synchronization signal MFSYNC is input, at the input timing of the line synchronization signal MLSYNC, the controller 150 transfers the image data (DATA) to the video input unit 202. Therefore, the frame synchronization signal MFSYNC is also an image transfer request signal.

The video input unit 202 is a process-function unit of an interface to the controller 150 in the plotter control unit 200. However, an operation clock frequency of the plotter control unit 200 is different from an operation clock frequency of the controller 150. Therefore, the transferred image data are temporarily stored in the line memory 203, then, based on the operation clock of the plotter control unit 200, a frequency conversion is performed for image data read. Then, after adding an internal pattern or performing image processes such as a trimming process, the data are transferred to the image process unit 204 line by line.

It should be noted that in the case where a process like a jaggy correction which requires a line memory is performed at the time of image processing in the video input unit 202, a line memory for image processing is used.

Also, in the case where a line head 182 is used as a light source in writing (LEDA write), an area gradation correction is also performed. The area gradation correction is a control method for realizing an area gradation in which, taking advantage of the LEDA being binary-driven and having a high resolution in a sub-scanning direction, an area gradation is realized by converting one pixel to multiple lines in the sub-scanning direction and by partially turning off the lines.

It is desirable that the area gradation correction is performed right after the conversion of increased resolution in the sub-scanning direction. Therefore, the video input unit 202, at the time of LEDA write, performs conversion of an input image to increase the resolution in the sub-scanning direction, and also performs an area gradation correction right after the conversion.

The image process unit 204 performs image processing on the image data input from the video input unit 202 line by line, and transfers the data to the skew correction unit 206 line by line.

The image process unit 204 is capable of creating a test pattern or an anti-counterfeiting pattern which is superimposed on the image data transferred from the video input unit 202, and various adjustment patterns which are created by the plotter control unit 200 alone. The adjustment patterns have three types including a concentration adjustment pattern, a color matching adjustment pattern, and a pattern for preventing a blade from being ridden up (a photoconductor total exposure pattern).

The skew correction unit 206 performs a skew correction process by sequentially storing the image data transferred from the image process unit 204 into a plurality of line memories of a skew correction line memory group 207, and reading out the image data in a line memory while switching the line memory as a reading target among the line memories according to an image position. It is also possible to perform a frequency conversion when writing and reading the skew correction line memory group 207.

The pixel count unit 205 measures an amount of data on which image processing is performed by the image process unit 204. Here, pixel information which most closely indicates real toner consumption can be obtained because the pixel count unit 205 can also count pixels of a test pattern or an anti-counterfeiting pattern which is superimposed on the transferred image data, and pixels of the various adjustment patterns which are created by the plotter control unit 200 alone.

However, in the case where the laser diode 181 as a light source is used for the writing, the toner consumption per pixel further changes due to the gradation conversion at the gradation conversion unit 208. Therefore, it is preferable to perform a pseudo gradation conversion also on the image data input to the pixel count unit 205.

When performing the skew correction at the skew correction unit 206, by making the line frequency during a read process 1/N (N is a natural number) of the line frequency during a write process, the data can be read N times from one line of memory, and thereby, the data after the skew correction become high density data in which the resolution in the sub-scanning direction is N times the resolution during the write process (double density process).

The emission data which are the image data on which the skew process and the double density process have been performed by the skew correction unit 206 are transferred in a manner shown below according to the optical system for the transfer.

Here, an optical system in which the laser diode 181 is used as a light source for light writing is referred to an LD optical system, an optical system in which a line head 182 is used is referred to a line head optical system, and an optical system in which a surface emitting laser 183 is used is referred to a VCSEL optical system.

LD optical system

The laser diode 181 is capable of emitting multi-level data light by using PWM modulation (time division lighting time control using a high-speed clock). Therefore, the emission data are transferred to the gradation conversion unit 208, and after the gradation conversion process is performed on the transferred data, the data are transferred to the LD driver 171 outside the plotter control unit 200, and thereby, the LD driver 171 performs the light writing by causing the laser diode 181 to emit light according to the emission data. It should be noted that the laser diode (LD) includes various types of LDs including a single LD, a multi LD, an LD array, etc.

Line head optical system

Depending on a dot array of a line head, a data array needs to be converted according to the wiring. Therefore, the emission data are transferred to the array conversion unit 209, and after the array conversion process is performed on the transferred data, the data are transferred to the line head driver 172 outside the plotter control unit 200, and thereby, the line head driver 172 performs the light writing by causing the line head 182 to emit light according to the emission data.

In the case where the array conversion by the array conversion unit 209 extends to the entire line, another line memory group is arranged here, and after the image data on which the skew correction process has been performed by the skew correction unit 206 are sequentially stored in the line memory group, the data on which the array conversion is performed are read. The line head 182 includes, other than the light-emitting diode array (LEDA), a line head in which an organic EL element is used.

VCSEL optical system

The emission data are transferred to the 8B/10B conversion unit 210 and a data conversion and a symbol code addition are performed on the transferred data. The data which have been converted from 8-bit data to 10-bit data by the 8B/10B conversion unit 210 are, after being converted to serial data by the serial conversion unit 211, transferred to the VCSEL driver 173 outside the plotter control unit 200. Here, the emission data are converted again to the original 8-bit data, and the surface emitting laser (VCSEL) 183 performs the light writing by emitting light according to the 8-bit data after the re-conversion.

[Mechanism Unit of Image Forming Apparatus]

FIG. 2 illustrates an example of a mechanism unit which is included in an engine unit of the image forming apparatus 100, which is a digital color image forming apparatus with an exposure apparatus of an LD optical system using a tandem type intermediate transfer method.

The engine unit of the image forming apparatus 100 includes, for example, an exposure apparatus 102, a tandem type color image formation unit 112, and a transfer unit 122 including an intermediate transfer belt 114 which is an endless type intermediate transfer medium.

The exposure apparatus 102 is an exposure means, and includes optical elements as four light sources including a laser diode and a polygon mirror. The tandem type color image formation unit 112 includes image formation process units (image forming units) 110, 108, 106, 104 for corresponding colors of yellow (Y), magenta (M), cyan (C), and black (Bk)

The image formation process units 110, 108, 106, 104 of the tandem type color image formation unit 112 include corresponding drum-shaped photoconductors (hereinafter referred to "photoconductor drum") 110*a*, 108*a*, 106*a*, 104*a* as image bearers. Around the photoconductor drums 110*a*, 108*a*, 106*a*, 104*a*, corresponding charging devices 110*b*, 108*b*, 106*b*, 104*b*, corresponding developing devices 110*c*, 108*c*, 106*c*, 104*c*, and primary transfer rollers 110*d*, 108*d*, 106*d*, 104*d*, etc., are arranged.

The exposure apparatus 102 as an exposure means is, in this embodiment, a multi-beam scanning apparatus.

Further, four laser beams emitted from laser diodes of four light source units (not shown) are deflected by a two-tier polygon mirror 102*c* as a deflector, and incident on an fθ lens 102*b*. The laser beams correspond to colors of Y, M, C, Bk, and are, after passing through the fθ lens 102*b*, reflected by a reflecting mirror 102*a*.

The reflected laser beams are, after being shaped by going through a WTL lens 102*d*, reflected by a plurality of reflecting mirrors 102*e*, and become laser beams L which are used for exposure. The laser beams L expose to-be-scanned surfaces (hereinafter also simply referred to "surfaces") of the photoconductor drums 110*a*, 108*a*, 106*a*, 104*a* of the image formation process units 110, 108, 106, 104 by emitting light onto the surfaces.

As described above, multiple optical elements are used for emitting the laser beams L onto the surfaces of the photoconductor drums 110*a*, 108*a*, 106*a*, 104*a*. As a result, a timing synchronization is performed for a main-scanning direction and a sub-scanning direction.

It should be noted that "main-scanning direction" is defined as a scanning direction of the laser beams, and "sub-scanning direction" is defined as a direction orthogonal to the main-scanning direction, which is, in the image forming apparatus 100, a direction in which the photoconductor drums 110*a*, 108*a*, 106*a*, 104*a* rotate, that is, a moving direction of the surfaces of the photoconductor drums.

Each of the photoconductor drums 110*a*, 108*a*, 106*a*, 104*a* has, on a conductive drum made of aluminum, etc., a photoconductive layer including at least a charge generation layer and a charge transport layer.

A surface electric charge is applied to the photoconductive layers by respective chargers 110*b*, 108*b*, 106*b*, 104*b*, and thereby each of the photoconductive layers is charged. The chargers 110*b*, 108*b*, 106*b*, 104*b* can be corotrons, scorotrons, charging rollers, or the like. The surface of the charged photoconductive layer of each of the photoconductor drums 110*a*, 108*a*, 106*a*, 104*a* is exposed to the laser beam L from the exposure apparatus 102 according to the image data, and a two-dimensional electrostatic latent image is formed (image writing is performed).

It should be noted that the forming of the electrostatic latent image and a toner image which will be described later are started sequentially in the order of Y, M, C, Bk in this embodiment.

The electrostatic latent images formed on the surfaces of the photoconductor drums 110*a*, 108*a*, 106*a*, 104*a* are developed by the developing devices 110*c*, 108*c*, 106*c*, 104*c* by using toner as a developer of respective colors Y, M, C, Bk, and toner images of respective colors are formed.

The toner images of respective colors are transferred onto the intermediate transfer belt 114 moving in an arrow B direction, sequentially in the order of Y, M, C, Bk at a primary transfer unit where the photoconductor drums are opposed to respective primary transfer rollers 110*d*, 108*d*, 106*d*, 104*d* having the intermediate transfer belt 114 nipped between the photoconductor drums and the primary transfer rollers.

Transfer bias voltage is applied to each of the primary transfer rollers 110*d*, 108*d*, 106*d*, 104*d*.

The intermediate transfer belt 114 is put on conveyance rollers 114*a*, 114*b*, 114*c* and is rotated in the arrow B direction by the conveyance rollers 114*a* and 114*c* one of which is a drive roller. The intermediate transfer belt 114, onto whose surface toner images of Y, M, C, Bk are transferred in an overlapping manner and on which a full color toner image is borne, is conveyed to a secondary transfer unit.

The secondary transfer unit includes a secondary transfer belt 118 which is conveyed in an arrow C direction by conveyance rollers 118*a*, 118*b*. The conveyance roller 114*b* for the intermediate transfer belt 114 also performs a function of a secondary transfer opposing roller.

To the secondary transfer unit, a sheet type recording medium 124 such as a high-quality paper or a plastic sheet is supplied from a recording medium container 128 such as a sheet feeding cassette by a conveyance roller 126.

Further, by applying a secondary transfer bias to the conveyance roller 114*b* which has a function of a secondary transfer opposing roller, the full color toner image borne on the intermediate transfer belt 114 is transferred onto the recording medium 124 which is adhered and held on a secondary transfer belt 118.

The recording medium 124 onto which the full color toner image has been transferred is conveyed to a fixing device 120 according to the movement of the secondary transfer belt 118 in the arrow C direction.

The fixing device 120 which includes a fixing roller 130 including a silicone rubber or a fluorine-containing rubber, by pressurizing and heating the recording medium 124 onto which the toner image is transferred, fixes the toner image onto the recording medium 124. Afterward, the recording medium 124 as printed matter 132 is discharged to the outside of the image forming apparatus 100.

After the toner image is transferred from the intermediate transfer belt 114, transfer residual toner is removed from the intermediate transfer belt 114 by a cleaning unit 116 including a cleaning blade, and the intermediate transfer belt 114 is ready for the next image forming process.

[Overview Description of Parameter Setting]

The present embodiment is characterized by a function in which the CPU 160 shown in FIG. 1 sets parameters of each page and each color in each unit of the plotter control unit 200 in this tandem type image forming apparatus.

In short, using registers controlled by addresses (first storage means), one page worth of setting values of various parameters for each color stored in the registers are stored in another storage area (second storage means) just before the start of image formation for the respective color. Further, at the start timing of the image formation for each color of the page, the setting values of the various parameters stored in the second storage means are reflected in operations of each of the process-function units. By optimizing for each of the process functions the timing of storing the setting values of the various parameters in the second storage means, a period in which parameters can be set in the registers (first storage means) is maximized.

A summary of the above feature will be described in detail referring to FIGS. 3-6.

Figure 3:
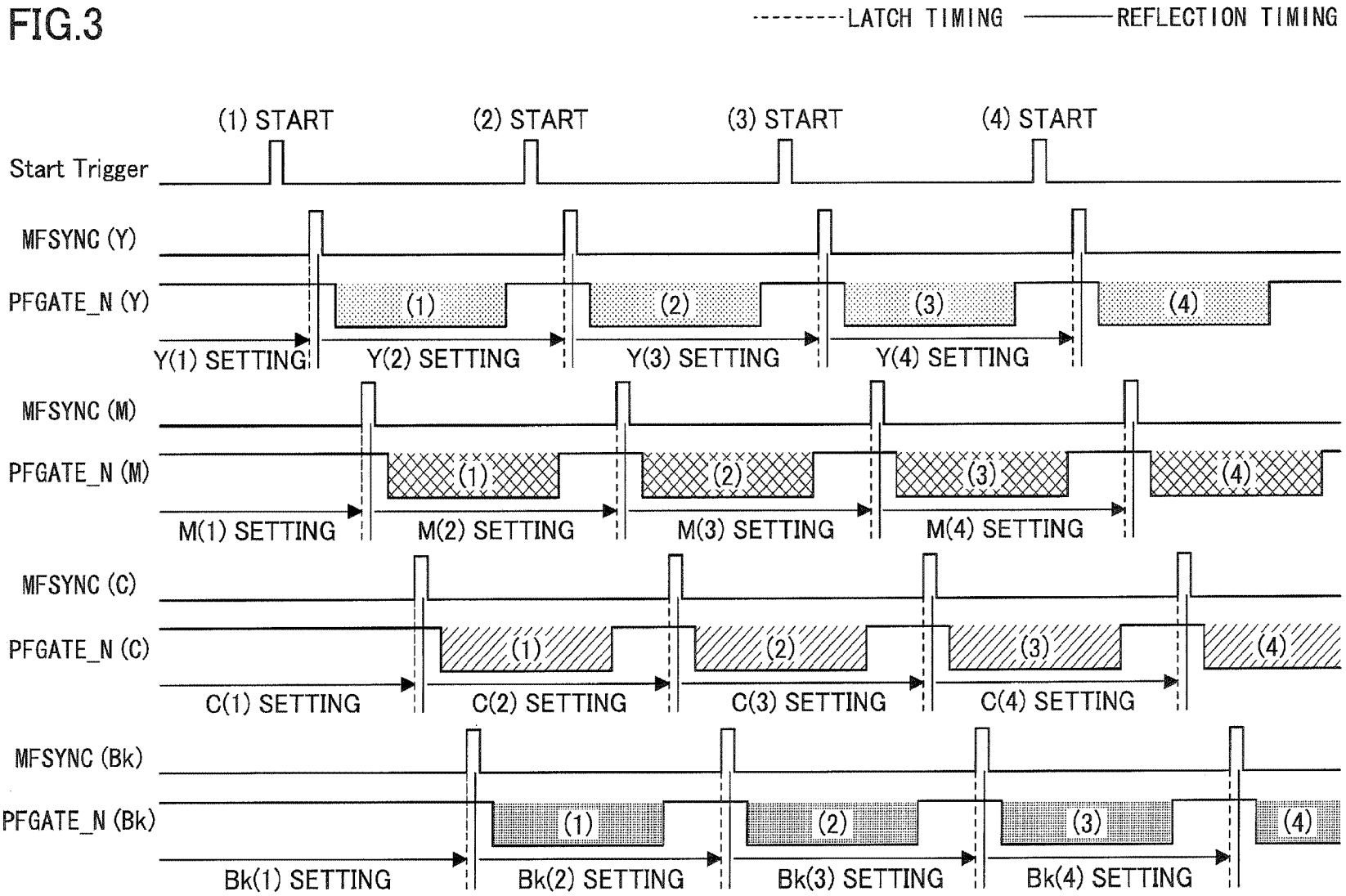
FIG. 3 is a timing diagram illustrating parameter setting and reflection timings by a MFSYNC assert time latch system in the image forming apparatus shown in FIG. 1 and FIG. 2.

FIG. 3 is a timing diagram illustrating parameter setting and reflection timings by a MFSYNC assert time latch system in the image forming apparatus shown in FIG. 1 and FIG. 2.

In FIG. 3, Y means yellow, M means magenta, C means cyan, Bk means black. FIG. 3 shows an example case of forming a color image using the four colors. Also, (1) through (4) respectively mean the first page through the fourth page in the case where a number of pages which can be arranged in an interval from the first image formation color (Y) to the last image formation color (Bk) is four.

In this MFSYNC assert time latch system (hereinafter abbreviated to "MFSYNC latch system"), one page worth of parameters set in registers of the first storage means are latched in the second storage means just before the start of image formation of each page. This is a kind of a page latch system.

In the present invention, all of the setting values of the various parameters are latched by the page latch system. An MFSYNC latch system's latch timing is one of the fastest.

Start Trigger shown in FIG. 3 is a start trigger signal which is a trigger signal common for all colors indicating a starting point of image formation for all function units of the plotter control unit 200 for each channel. The CPU 160 in FIG. 1 transmits Start Trigger to each of the plotter control units 200.

MFSYNC (Y), (M), (C), (Bk) are frame synchronization signals indicating page tips of corresponding colors and are used for requesting the controller 150 to start transferring image data just before the start of image formation of the page for each color. Hereinafter, MFSYNC (Y), (M), (C), (Bk) are collectively referred to a frame synchronization signal MFSYNC.

PFGATE_N (Y), (M), (C), (Bk) are signals which indicate actual image formation periods (Low period) for respective colors. PFGATE_N (Y), (M), (C), (Bk) are collectively named as a PFGATE_N signal.

The PFGATE_N signal is an external signal connected to the CPU 160. The CPU 160 controls paper conveyance timing according to the PFGATE_N signal timing. Also, there is a method in which PFGATE_N signal as an external signal is not used, assert and negate edge of the PFGATE_N signal is reflected in a register, and the CPU monitors the change of the register value as an interrupt signal.

These signals are generated by the plotter control unit 200 for each channel in FIG. 1 after the start trigger signal is received. The PFGATE_N signal corresponds to a first timing signal which starts the image write by operating the plurality of process-function units.

The frame synchronization signal MFSYNC corresponds a second timing signal which asserts earlier than the first timing signal, and asserts earlier than any of the other second timing signals which will be described later.

In the MFSYNC latch system, at the same time as the frame synchronization signal MFSYNC asserts, the parameter setting values which have been set by then in each register of the first storage means are latched and stored in the second storage means as another storage area. Starting immediately after the second storage means stores the setting values, the setting values are reflected in the image generation of the page.

Therefore, the parameter setting available period in which parameters can be set by the CPU 160 in each of the registers of the first storage means starts at the latest at the PFGATE_N signal assert timing after the latch completion of the previous page. The parameter setting available period ends at the assert timing of the frame synchronization signal MFSYNC of the page (just before the PFGATE_N signal assert timing). It should be noted that after the assert timing of the frame synchronization signal MFSYNC of the page, until about 20 ms before the PFGATE_N signal assert timing, parameter setting in the registers is not available.

The image formation starts from the first page (1) of yellow (Y) and, a little after the first page (1) of yellow (Y), the image formation of the first page (1) of magenta (M) starts. After that, the image formation of the first page (1) of cyan (C), and the first page (1) of black (Bk) sequentially start, thereby, onto the intermediate transfer belt 114 shown in FIG. 2, toner images of yellow, magenta, cyan, and black are sequentially transferred in an overlapping manner, and a color image of the first page is formed.

FIG. 4 is an illustration showing an example of MFSYNC latch parameters. In the figure, a target register, a latch timing of another storage area, a reflection timing of image formation operations of process-function units, and a latch ON/OFF are shown.

In an example of FIG. 4, the target register is a sub-scanning counter initial value setting register which is a register for setting an initial value of a sub-scanning counter which determines a print area and a print start timing.

It should be noted that in FIG. 4, it is shown that the latch timing is "MFSYNC (IMFSYNC) assert timing", and the reflection timing is "MFSYNC (IMFSYNC) assert timing". The "IMFSYNC" is a plotter control unit internal frame synchronization signal which is used when operating a "dummy FGATE" in which an image is formed by the plotter control unit 200 alone without having image transfer from the controller 150. Detailed explanation is omitted, but "IMFSYNC" is used as a starting point of "latch timing" and "PFGATE_N signal assert timing" both when the MFSYNC is used for a normal print and when operating "dummy FGATE".

The parameter setting values are used in the case where it is determined that the plotter control unit 200 can operate when there is a response from the controller 150 after the video input unit 202 shown in FIG. 1 transmits the frame synchronization signal MFSYNC to the controller 150.

Regarding the sub-scanning counter initial value setting register, ON(enabled)/OFF(disabled) of latch can be switched. The initial value is ON. When the latch setting is OFF, values set by the CPU 160 are reflected in real time in operations of the video input unit 202.

Regarding the selection criteria of target registers of the MFSYNC latch, it is recommended that the criteria is such that registers for setting the following high priority parameters are selected.

- Setting values for a circuit which operates immediately after the frame synchronization signal MFSYNC asserts (the video input unit 202 in FIG. 1)
- Setting values of parameters which require early setting due to the use for the page tip
- Setting values which define the interface with the controller 150 and whose setting timing depends on other than the write control apparatus such as on the controller 150

Parameter setting values which are used by the video input unit 202 and which meet the above selection criteria includes the following setting values. It is preferable that these parameter setting values are also set by the page latch of the MFSYNC latch system. In the case where a memory area is not sufficient, multiple memory areas may be used as registers for these parameter setting values.

MFSYNC sub-scanning delay amount setting value:

an initial value of a down counter MFCOUNT which controls the time from reception of the start trigger signal to the assert timing of the frame synchronization signal MFSYNC for each color. By making the values different among different colors, it becomes possible to form a color image by superimposing images of different colors at the same position on the page.

Latch signal sub-scanning delay amount setting value:

a value for determining a delay time from the reference timing for generating a latch timing signal in order to latch and reflect the setting values page by page. The reference timing is the assert timing of the frame synchronization signal MFSYNC.

Dummy FGATE delay generation enable setting value:

a setting value for masking the frame synchronization signal transmission to the controller 150 when image formation is performed without receiving the image data from the controller 150 for a certain color, for example, when performing a monochrome printing.

In other words, a setting value for an operation forming an image by the plotter control unit 200 alone without receiving image transfer from the controller 150. For example, there is a function of two color printing in which only black Bk and magenta M are used to reduce toner consumption.

In such a case, if the control algorithm includes a dedicated print mode for two-color printing, then it may become a complicated control. Also, because a photoconductor drive motor is common for cyan, magenta, and yellow, if the photoconductor and the developing unit for magenta are controlled to perform image formation for magenta, then the photoconductors and the developing units for cyan and yellow also need to be controlled. In order to control the photoconductors and the developing units for cyan and yellow, image data are not needed but FGATE is needed for monitoring the timing.

Therefore, by using the "dummy FGATE", blank image data corresponding to cyan and yellow are created by the plotter control unit 200, FGATE whose timings are the same as normal printing is generated, and the photoconductors and the developing units for cyan and yellow are controlled.

Dummy FGATE sub-scanning delay amount setting value:

an initial value of a timing adjustment counter used for aligning color data receiving from the controller 150 and an delay amount when transmission of the frame synchronization signal MFSYNC to the controller 150 is masked.

MFSYNC main-scanning output position setting value:

a value for fine tuning of transmission timing of the frame synchronization signal MFSYNC to the controller 150.

MFSYNC output enable setting value:

a setting value for enabling transmission of the frame synchronization signal MFSYNC to the controller 150.

The "MFSYNC output enable" function is used for, when an ASIC installed in the plotter control unit 200 is commonly used in a color model and a monochrome model, in a monochrome model, completely disabling operations of color versions other than black.

MLSYNC output number setting value:

a number value of the line synchronization signals MLSYNC transmitted to the controller 150 in one line.

MLSYNC main scanning offset amount setting value:

a value for fine tuning of transmission timing of the line synchronization signal MLSYNC to the controller 150.

MLSYNC main scanning output interval setting value:

a value for fine tuning of transmission intervala of the line synchronization signal MLSYNC to the controller 150.

Next, FLOAD assert time latch system will be described referring to FIG. 5 and FIG. 6.

Figure 5:
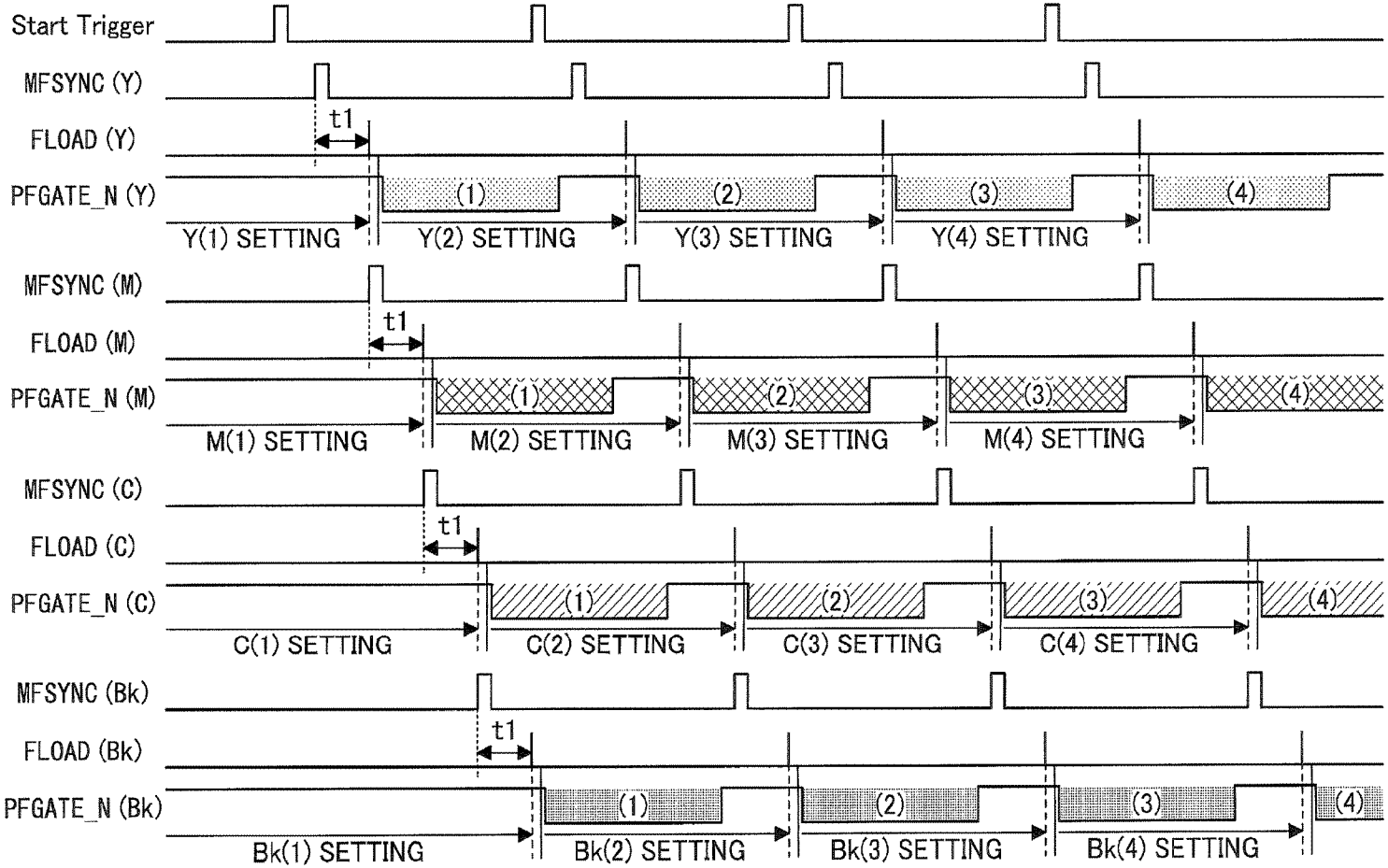
FIG. 5 is a timing diagram illustrating parameter setting and reflection timings by a FLOAD assert time latch system in the image forming apparatus shown in FIG. 1 and FIG. 2.

FIG. 5 is a timing diagram illustrating parameter setting and reflection timings by a FLOAD assert time latch system (hereinafter abbreviated to "FLOAD latch system") in the image forming apparatus shown in FIG. 1 and FIG. 2. Notation of signal names, etc., in FIG. 5 is the same as in FIG. 3.

In the FLOAD latch system, at the assert timing of FLOAD (Y), (M), (C), (Bk) signals (hereinafter, collectively referred to "FLOAD signal") just before the start of image formation of the page for each color, parameters which have been set by then in registers of the first storage means are latched and stored in the second storage means. Further, the parameters are reflected in the image formation process of the page by the plotter control unit 200 in the system.

After the video input unit 202 shown in FIG. 1 transmits the frame synchronization signal MFSYNC to the controller 150, in the case where there is a response from the controller 150, the FLOAD signal asserts after delaying for time t1 from the frame synchronization signal MFSYNC. This FLOAD signal is also a second timing signal which asserts earlier than the first timing signal PFGATE_N signal.

In each register of the first storage means of the FLOAD latch system, before the FLOAD signal of the page (internal signal of the plotter control unit 200) asserts, parameter values for each page and each color are stored. The values set in each register are, at the assert timing of the FLOAD signal for each color and each page, latched in the second storage means as another memory area, and immediately reflected in operations of the process-function units such as the video input unit 202.

A register setting available period of the FLOAD latch system is from the assert timing of the PFGATE_N signal for the previous page to the assert timing of the FLOAD signal for the current page (just before the assert timing of the PFGATE_N signal). Register setting is not available after the assert timing of the FLOAD signal for the current page until about 1 ms before the assert timing of the PFGATE_N signal.

FIG. 6 is an illustration showing an example of FLOAD latch parameters.

Selection criteria of the target register of the FLOAD latch includes the following two items.

Setting values for a circuit which starts operation immediately after the operation of the sub-scanning counter Setting values for a circuit which is the same circuit as generating the sub-scanning counter (the video input unit 202 in FIG. 1)

The example shown in FIG. 6 includes the following registers as a target register.

Transfer image size (main scanning) setting register:

after the operation of the sub-scanning counter, sets a main scanning width of the image size transferred from the controller 150.

Transfer image size (sub-scanning) setting register:

after the operation of the sub-scanning counter, sets a sub-scanning width (=end value of the sub-scanning counter) of the image size transferred from the controller 150.

Input image resolution setting register:

after the operation of the sub-scanning counter, sets a resolution of the image transferred from the controller 150.

Input image double density process (main scanning) setting register:

after the operation of the sub-scanning counter, sets a number of double density by which the image transferred from the controller 150 is simply multiplied in the main-scanning direction.

Input image double density process (sub-scanning) setting register:

after the operation of the sub-scanning counter, sets a number of double density by which the image transferred from the controller 150 is simply multiplied in the sub-scanning direction.

Output image resolution setting register:

after the operation of the sub-scanning counter, sets a resolution of the image output by the plotter control unit 200.

Output image main scanning start position setting register:

after the operation of the sub-scanning counter, sets a main scanning start position of the image output by the plotter control unit 200.

Output image main scanning width setting register:

after the operation of the sub-scanning counter, sets a main scanning width of the image output by the plotter control unit 200.

Sub-scanning counter ending delay setting counter:

after the operation of the sub-scanning counter, in the case of adding the end value of the sub-scanning counter to the sub-scanning width of the image size transferred from the controller 150, sets the additional amount. It is used when image addition occurs in the video input unit 202 or in the unit after the video input unit 202 such as the skew correction unit 206.

Area gradation correction setting register:

at the time of line head write, in order to perform the area gradation correction at the video input unit 202, sets the correction state.

By doing the above, in the MFSYNC latch system and the FLOAD latch system, timings for storing and reflecting parameters are automatically adjusted such that the video input unit 202 can use the parameters at the best timings, thereby, the period when the CPU 160 can set the parameters in the registers of the first storage means is maximized.

[Detailed Description of Plotter Control Unit]

Next, a configuration and a function of the plotter control unit 200 according to the present invention in FIG. 1 will be described more in detail.

Figure 7:
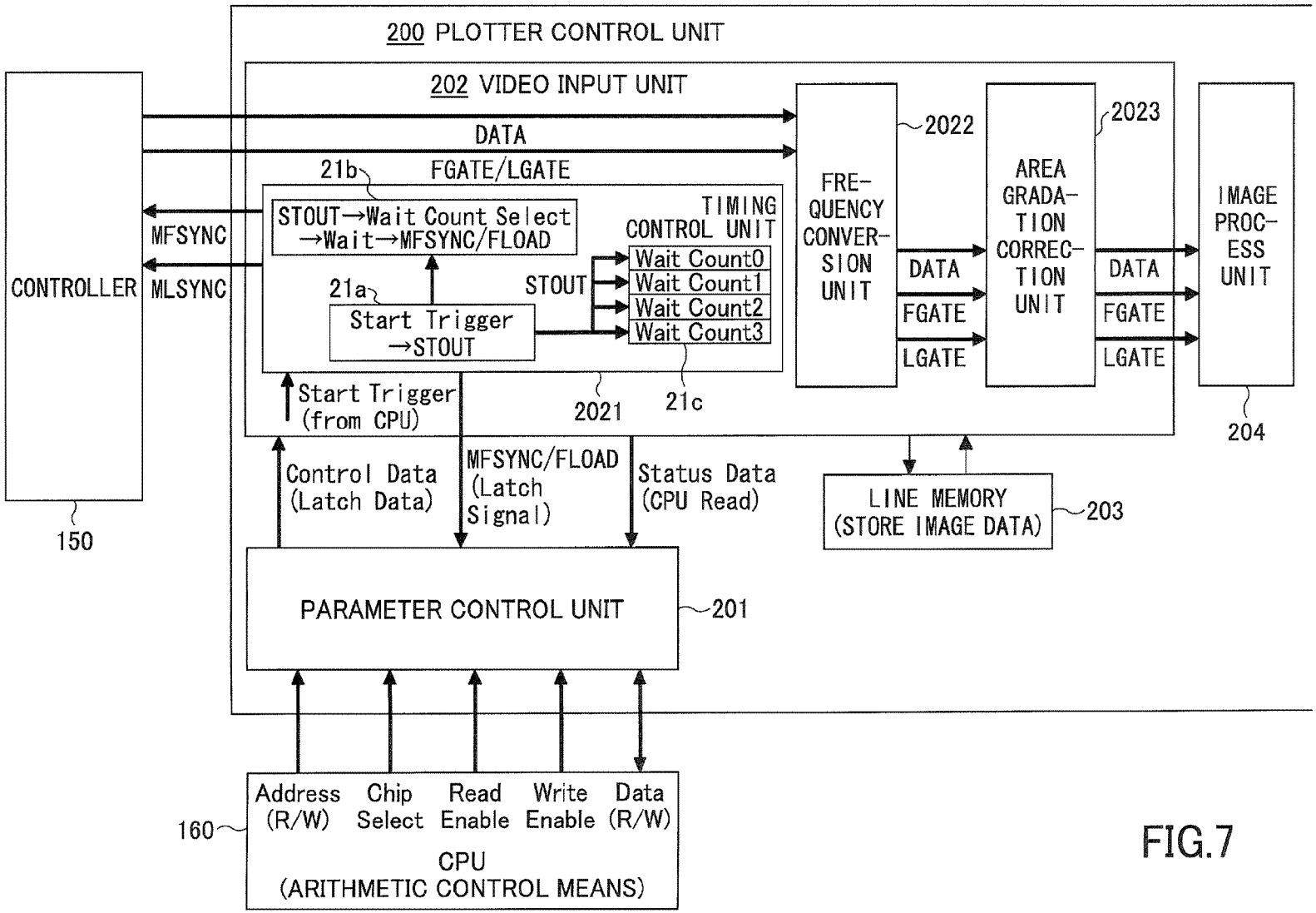
FIG. 7 is a block diagram illustrating a CPU 160 and a main section of a plotter control unit 200 together with an internal configuration example of a video input unit 202.
Figure 8:
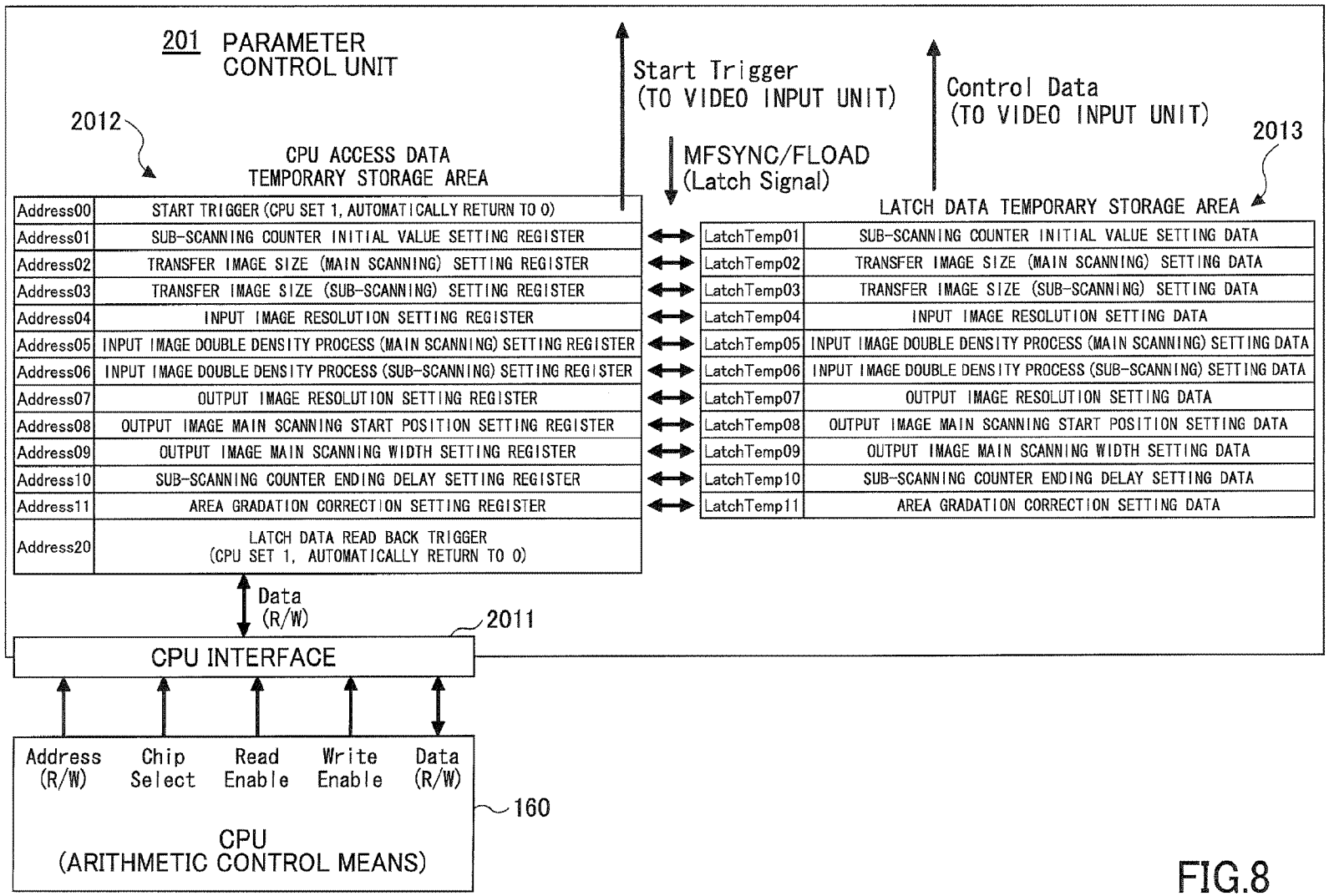
FIG. 8 is a block diagram illustrating a storage example of parameter setting values according to the MFSYNC latch system and the FLOAD latch system in a parameter control unit 201 in FIG. 7.

FIG. 7 is a block diagram illustrating the CPU 160 and a main section of the plotter control unit 200 together with an internal configuration example of the video input unit 202. FIG. 8 is a block diagram illustrating a storage example of parameter setting values according to the MFSYNC latch system and the FLOAD latch system in the parameter control unit 201 in FIG. 7. In these figures, the same numerals is applied to a unit corresponding to a unit in FIG. 1.

The video input unit 202 in the plotter control unit 200 shown in FIG. 7 includes a timing control unit 2021, a frequency conversion unit 2022, and an area gradation correction unit 2023.

The timing control unit 2021 includes a STOUT signal generation unit 21*a*, an MFSYNC/FLOAD generation unit 21*b*, and a wait time (Wait) control unit 21*c*.

The STOUT signal generation unit 21*a* generates a STOUT signal by synchronizing with a start trigger signal (Start Trigger) from the parameter control unit 201.

The wait time (Wait) control unit 21*c* includes four counters: Wait Count 0 through Wait Count 3. Each counter is a counter for controlling time from the start of each of pages (1) through (4) (start trigger signal assert timing) until a tip of each page for each color (frame synchronization signal MFSYNC assert timing).

Wait Count 0: controls time from "(1) Start" until "(1) Tip" for each color

Wait Count 1: controls time from "(2) Start" until "(2) Tip" for each color

Wait Count 2: controls time from "(3) Start" until "(3) Tip" for each color

Wait Count 3: controls time from "(4) Start" until "(4) Tip" for each color

In an example shown in FIG. 3 and FIG. 5, operations are performed on pages in the order of (1)->(2)->(3)->(4)->(1) - - - , that is, (1)-(4)->(1)-(4), repeatedly. The above operation is referred to as "toggle operation".

In accordance with the above operation, in the wait time control unit 21*c*, each time a STOUT signal is input from the STOUT signal generation unit 21*a*, a toggle operation is performed as follows: Wait Count 0->Wait Count 1->Wait Count 2->Wait Count 3->Wait Count 0- - - .

When a STOUT signal is input from the STOUT signal generation unit 21*a*, the MFSYNC/FLOAD generation unit 21*b* selects the counter of the wait time control unit 21*c* which has been just switched. Then, after waiting the time controlled by the counter, the MFSYNC/FLOAD generation unit 21*b* generates a frame synchronization signal MFSYNC.

Further, after delaying a constant time t1 shown in FIG. 5 from an assert timing of the frame synchronization signal MFSYNC, the MFSYNC/FLOAD generation unit 21*b* generates a FLOAD signal, which is the above-described second timing signal.

Therefore, the timing control unit 2021 is a timing signal generation means.

The video input unit 202 also generates a line synchronization signal MLSYNC which is a trigger signal for starting write for each line and each page.

Further, the video input unit 202 outputs the frame synchronization signal MFSYNC and the line synchronization signal MLSYNC to the controller 150, thereby, after the frame synchronization signal MFSYNC is input, at the input timing of the line synchronization signal MLSYNC, the controller 150 transfers the image data DATA to the video input unit 202.

At this time, the controller 150 also transmits a frame gate signal FGATE and a line gate signal LGATE to the video input unit 202, and FGATE and LGATE together with the image data DATA are input to the frequency conversion unit 2022.

An operation clock frequency of the plotter control unit 200 is different from an operation clock frequency of the controller 150. Therefore, the frequency conversion unit 2022 performs a frequency conversion in which the frequency conversion unit 2022 temporarily stores the image data DATA which have been transferred to the controller 150 in the line memory 203, and in accordance with the operation clock of the video input unit 202, that is, of the plotter control unit 200, reads the image data.

Also, in the case of write which uses the line head 182 as a light source (LEDA write), the image data are transmitted to the image process unit 204 after an area gradation correction is also performed by the area gradation correction unit 2023. This is a control method for realizing an area gradation in which, taking advantage of the LEDA which is binary driven and has a high resolution in a sub-scanning direction, an area gradation is realized by converting one pixel to multiple lines in the sub-scanning direction and by turning off a unit of the lines.

However, in the case other than the LEDA write, the area gradation correction unit 2023 is not operated, and input image data DATA is output as it is to the image process unit 204.

Together with the image data DATA, the frame gate signal FGATE and the line gate signal LGATE are transmitted from the frequency conversion unit 2022 to the image process unit 204 through the area gradation correction unit 2023. Description of each of the process-function units including the image process unit 204 and thereafter will be herein omitted.

The video input unit 202 transmits a frame synchronization signal MFSYNC or a FLOAD signal which is the second timing signal generated at the timing control unit 2021 as a latch signal to the parameter control unit 201.

Further, the video input unit 202 reads status data (Status Data) of the parameter control unit 201 according to the control of the CPU 160, and reads as control data (Control Data) the parameter setting values which are the latched data shown in FIG. 8.

The parameter control unit 201 receives from the CPU (arithmetic control means) 160 an address signal for read and write (Address R/W) and a chip select signal (Chip Select). Also, the parameter control unit 201 receives a read enable signal (Read Enable) or a write enable signal (Write Enable), and reads data and writes data (Data R/W) from/to the CPU 160.

It should be noted that, in this example, the external memory 161 shown in FIG. 1 is not connected to the parameter control unit 201, but may be connected to the parameter control unit 201 in order to increase memory capacity. In such a case, it is possible for the parameter control unit 201 to send an address signal for read and write (Address R/W) to the external memory 161 and read and write the latched data (Latch Data R/W) which are the parameter setting values.

The CPU 160 which controls all of the process-function units in the plotter control unit 200 uses the chip select signal to select the control-target process-function unit. Here, descriptions of the process-function units other than the parameter control unit 201 and the video input unit 202 are omitted.

Next, a specific example of parameter settings in the present embodiment will be described referring to FIG. 8. FIG. 8 shows a stored example of the parameter setting values according to the MFSYNC latch system and the FLOAD latch system which are described referring to FIGS. 3-6.

In the parameter control unit 201, a CPU interface 2011, a CPU access data temporary storage area 2012, and a latch data temporary storage area 2013 are arranged.

The CPU access data temporary storage area 2012 is the first storage means in which setting values of various parameters created by the CPU 160 are stored. The latch data temporary storage area 2013 is the second storage means in which one page worth of setting values stored in the first storage means are stored. For these areas, memories such as an SRAM or a FIFO or a non-volatile RAM are used.

Signals and data from the CPU 160 are input to the parameter control unit 201 via the CPU interface 2011, and used for controlling various units of the parameter control unit 201, and also used for controlling the various process-function units from the parameter control unit 201.

In the CPU access data temporary storage area 2012, in this example, there are storage areas (registers) of address00-address11, and address20. The CPU 160 can directly access these registers and read/write data.

Address00 is a start trigger register. When the CPU 160 sets "1" in this register, the start trigger signal asserts and the signal is transmitted to the timing control unit 2021 of the video input unit 202 described above. Immediately after this, the register automatically returns to "0".

The address01 is a sub-scanning counter initial value setting register which is a target register of the MFSYNC latch shown in FIG. 4.

The address02-11 are target registers of the FLOAD latch shown in FIG. 6, that is, the following registers.

Transfer image size (main scanning) setting register
Transfer image size (sub-scanning) setting register
Input image resolution setting register
Input image double density process (main scanning) setting register
Input image double density process (sub-scanning) setting register
Output image resolution setting register
Output image main scanning start position setting register
Output image main scanning width setting register
Sub-scanning counter ending delay setting counter
Area gradation correction setting register These registers are used for temporarily storing one page worth of setting values (data/information) of various parameters used by the video input unit 202 according to the CPU 160.

Address 20 is a register for the latch data read back trigger. The CPU 160 sets "1" in the register when necessary. Afterwards, the register automatically returns to "0". When "1" is set in the latch data read back trigger register, data in the latch data temporary storage area 2013 are overwritten into (read back to) the CPU access data temporary storage area 2012, thereby the data can be referred to from the CPU 160. This may be referred to as "the third storage means".

After the start trigger signal is transmitted from the parameter control unit 201 to the video input unit 202, the frame synchronization signal MFSYNC is input from the video input unit 202 to the parameter control unit 201. Taking the frame synchronization signal MFSYNC as a latch signal, the setting data stored in the sub-scanning counter initial value setting register at address01 of the CPU access data temporary storage area 2012 are overwritten (copied) to and stored in the LatchTemp01 of the latch data temporary storage area 2013. This operation is referred to as "latch".

Following the above, the FLOAD signal is input from the video input unit 202 to the parameter control unit 201. Taking the FLOAD signal as a latch signal, the setting data stored in the registers of address02-11 of the CPU access data temporary storage area 2012 are overwritten (copied) to and stored in the LatchTemp02-11 of the latch data temporary storage area 2013. In other words, the latch operation is performed.

The setting values of the various parameters which are temporarily stored in the LatchTemp01-11 of the latch data temporary storage area 2013 are read out by the video input unit 202 which is controlled by the CPU 160, and are reflected in the image formation process of the page.

In the MFSYNC latch system and the FLOAD latch system, it is necessary for the CPU access data temporary storage area 2012 and the latch data temporary storage area 2013 to hold only one page worth of the setting values of the parameters.

Also, the latch ON/OFF of the registers of the CPU access data temporary storage area 2012 can be switched. The initial value of the latch ON/OFF is ON (enabled). When the latch setting is OFF (disabled), values set by the CPU 160 are reflected in real time in the image formation operation of the video input unit 202.

At the time of a fatal error, because the latest setting values become effective in the next image forming process, only normal register settings are needed for the registers of the CPU access data temporary storage area 2012 at the recovery.

However, when image writing is interrupted due to a paper jam or machine trouble while printing, setting values of the registers of the CPU access data temporary storage area 2012 may be different from the data stored in the latch data temporary storage area 2013 which are reflected in the image forming process. As a result, an operation analysis at the time of image writing interruption is difficult. Therefore, there is a function in which "1" is set in the latch data read back trigger register, data in the latch data temporary storage area 2013 are overwritten to the CPU access data temporary storage area 2012, and thereby the data can be referred to from the CPU 160.

The above-described parameter control unit 201 is included in the plotter control unit 200. The plotter control unit 200 is provided for each of the colors, that is, Y, M, C, Bk, which are included in a color image. Therefore, the CPU access data temporary storage area 2012 as the first storage means is also provided for each color, and the latch data temporary storage area 2013 as the second storage means is also provided for each color.

Alternatively, only one plotter control unit 200 for all colors in common and process-function units including a video input unit 202 of the plotter control unit 200 for each of the colors may be provided, and the CPU access data temporary storage area 2012 as the first storage means and the latch data temporary storage area 2013 as the second storage means may have areas for different colors in one common memory.

In the case of a write control apparatus in a monochrome-only image forming apparatus, one color worth of the plotter control unit 200 including the parameter control unit 201 for one color needs to be arranged, that is, only one plotter control unit 200 including only one parameter control unit 201 needs to be arranged.

Types of registers of the CPU access data temporary storage area 2012 are not limited to the above-described examples, nor are the types of the setting data which are temporarily stored in the latch data temporary storage area 2013 which latch the setting data of the CPU access data temporary storage area 2012.

For example, the setting of other parameters described above which are used in the video input unit 202 may be performed by a setting method using the page latch of the MFSYNC latch system or the FLOAD latch system.

In such a case, if memory capacity is not sufficient, then a large-capacity memory may be used, or a connected external memory may be used. A location or a type of the storage area is not limited to the examples described above.

[LTSYNC Assert Time Latch System]

Next, a LTSYNC assert time latch system in the write control apparatus according to the present invention will be described.

Figure 9:
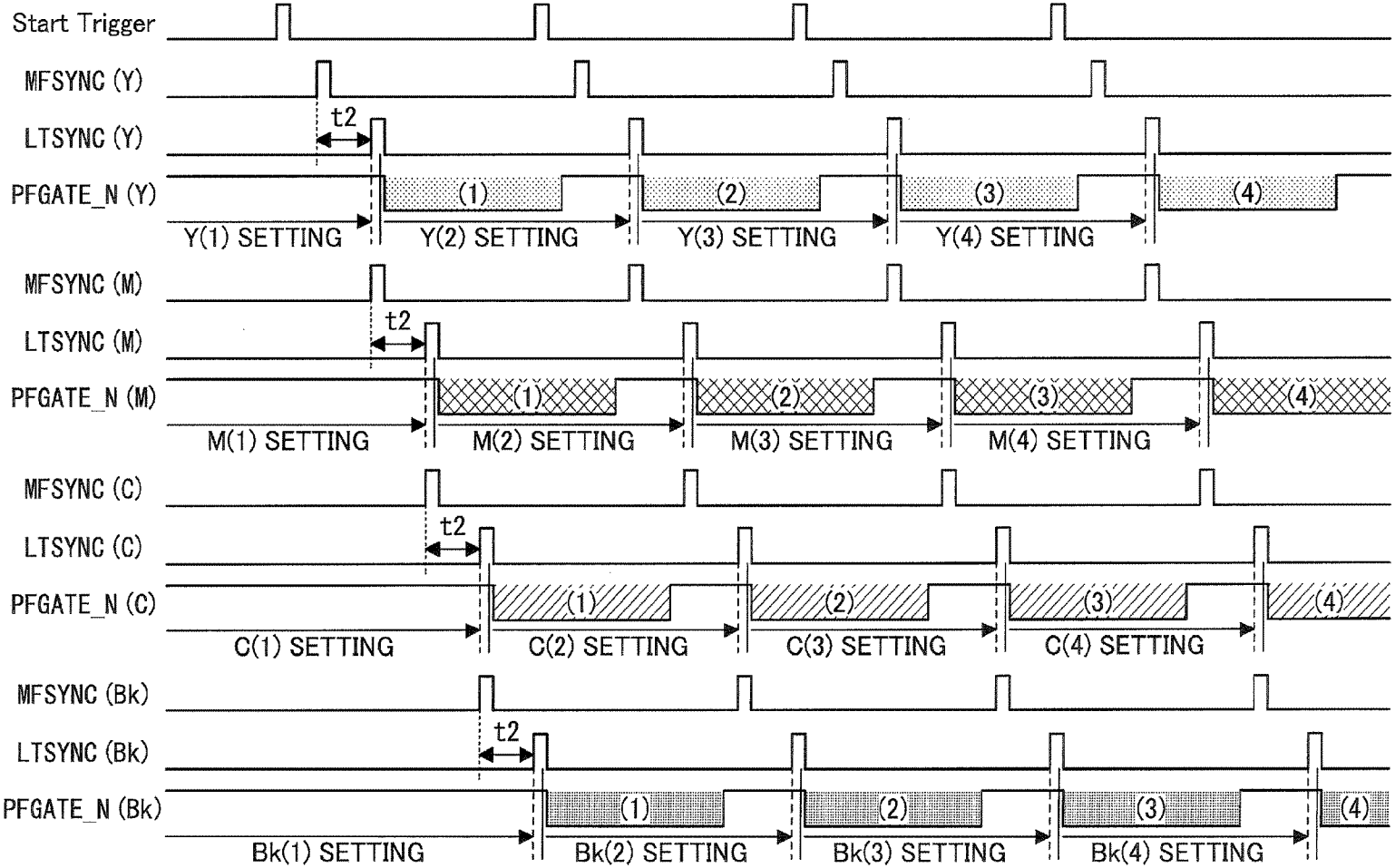
FIG. 9 is a timing diagram illustrating parameter setting and reflection timings by a LTSYNC assert time latch system in the image forming apparatus shown in FIG. 1 and FIG. 2.

FIG. 9 is a timing diagram illustrating parameter setting and reflection timings by a LTSYNC assert time latch system (hereinafter abbreviated to "LTSYNC latch system") in the image forming apparatus shown in FIG. 1 and FIG. 2. Notation of signal names, etc., in FIG. 9 is the same as in FIG. 3 and FIG. 5. FIG. 10 is an illustration showing an example of LTSYNC latch parameters.

The LTSYNC latch system is a system in which, just before the start of the image formation of the page of each color, the latch operation is performed at the same time as a latch synchronization signal LTSYNC asserts, which LTSYNC is a signal for adjusting freely the latch timing. By the latch operation, parameters set by then in registers of the first storage means are stored in the memory area of the second storage means, and are reflected in the image forming process of the page.

The latch synchronization signal LTSYNC is a signal provided for each color, which signal asserts with a set time t2 delay with respect to the frame synchronization signal MFSYNC. The set time t2 is slightly longer than time t1 which is a delay time of FLOAD signal shown in FIG. 5 (t2>t1).

This latch synchronization signal LTSYNC is also generated by the timing control unit 2021 of the video input unit 202, and corresponds to the second timing signal which asserts earlier than the first timing signal (PFGATE_N signal) used for the start of the image writing.

In the registers of the first storage means, one page worth of parameter values for each color are set before the latch synchronization signal LTSYNC asserts.

Further, the values set in the registers are, at the assert timing of the latch synchronization signal LTSYNC for the page, latched in the memory area of the second storage means, and immediately reflected in operations of the process-function units in the plotter control unit 200.

A period during which the registers of the first storage means can be set is from the assert timing of the PFGATE_N signal for the previous page to the assert timing of the latch synchronization signal LTSYNC for the current page (just before the assert timing of the PFGATE_N signal).

Register setting is not available from the assert timing of the latch synchronization signal LTSYNC until the assert timing of the PFGATE_N signal.

The assert timing of the latch synchronization signal LTSYNC can be adjusted by the LTSYNC assert timing setting register. When the number of lines set in the LTSYNC assert timing setting register is counted according to the line synchronization signal MLSYNC after the assert timing of the frame synchronization signal MFSYNC, the latch synchronization signal LTSYNC asserts.

If the latch synchronization signal LTSYNC signal and the LTSYNC assert timing setting register are independently provided for each of the process-function units, then LTSYNC assert timing can be set respectively for each of the process-function units.

The latch synchronization signal LTSYNC is a 32 clock high-active signal.

Normally, "63" is set in the LTSYNC assert timing setting register. The reason for "63" is that a delay amount of the controller 150 is normally "64", and, by setting "63", the latch synchronization signal LTSYNC asserts at the timing one line before.

When data transfer from the controller 150 is not required such as when generating an adjustment pattern or a test pattern, "0" is set in the LTSYNC assert timing setting register.

Therefore, in the LTSYNC latch system, the latch synchronization signal LTSYNC as the second timing signal is a timing variable signal whose assert timing can be adjusted using the setting value.

Further, the latch synchronization signal LTSYNC as a timing variable signal asserts after a set time has elapsed from the assert timing of the frame synchronization signal MFSYNC which is a timing signal indicating the controller 150 to start transferring of the image data.

Also, the latch synchronization signal LTSYNC as a timing variable signal can be provided for each of the plurality of the process-function units in the plurality of the plotter control units 200, and assert timing of each LTSYNC can be adjusted.

Referring to FIG. 10, a parameter example of the LTSYNC latch will be described.

Selection criteria of the target register of this LYSYNC latch includes the following.

- A register which is used by a plurality of the process-function units, thereby there are at least two latch timings
- A setting value for a circuit whose operation starts after a delay from the operation start of the sub-scanning counter (process-function units arranged in the subsequent stage of the video input unit 202 in FIG. 1)

A setting value, not for each color, but for a circuit which operates for each channel of the output optical system of the exposure means (process-function units arranged in the subsequent stage of the skew correction unit 206 in FIG. 1)

A transmission signal for a process-function unit used outside of the plotter control unit 200

A register group switching signal for a process-function unit which uses a double register system In an example of FIG. 10, the target registers which meet the above criteria are as follows.

A register of a parameter used in a plurality of the function units

For example, in the case of a register which is used both in the image process unit 204 and in the skew correction unit 206, the LTSYNC assert timing setting register LTSYNCDLY_R is set to match the timing of a process-function unit whose operation starts earlier (normally, the image process unit 204 which is in the earlier stage).

A register of a parameter used in the image process unit 204

Because the operation of the image process unit 204 starts in accordance with an output gate signal of the video input unit 202, it is required that the LTSYNC assert timing for the image process unit 204 is later than the timing of the video input unit 202.

A register of a parameter used in the skew correction unit 206

Because the operation of the skew correction unit 206 starts in accordance with an output gate signal of the image process unit 204, it is required that the LTSYNC assert timing for the skew correction unit 206 is later than the timing of the image process unit 204.

A register of a parameter used in the serial conversion unit 211

Because the operation of the serial conversion unit 211 starts in accordance with an output gate signal of the skew correction unit 206, it is required that the LTSYNC assert timing for the serial conversion unit 211 is later than the timing of the skew correction unit 206 (due to via a memory, there is one or more lines delay).

A register of a parameter used in the array conversion unit 209

Because the operation of the array conversion unit 209 starts in accordance with an output gate signal of the skew correction unit 206, it is required that the LTSYNC assert timing for the array conversion unit 209 is later than the timing of the skew correction unit 206 (due to via a memory, there is one or more lines delay).

A register of a parameter used in the gradation conversion unit 208

Because the operation of the gradation conversion unit 208 starts in accordance with an output gate signal of the skew correction unit 206, it is required that the LTSYNC assert timing for the gradation conversion unit 208 is later than the timing of the skew correction unit 206 (due to via a memory, there is one or more lines delay).

A register of a parameter used in the pixel count unit 205

Because the operation of the pixel count unit 205 starts in accordance with an output gate signal of the image process unit 204, it is required that the LTSYNC assert timing for the pixel count unit 205 is later than the timing of the image process unit 204.

A register of a transmission signal for a function unit used outside of the plotter control unit 200

A control signal is transmitted to the function unit outside of the plotter control unit 200. At this time, the LTSYNC assert timing is adjusted so that the timing satisfies the request of the function unit.

Figure 15:
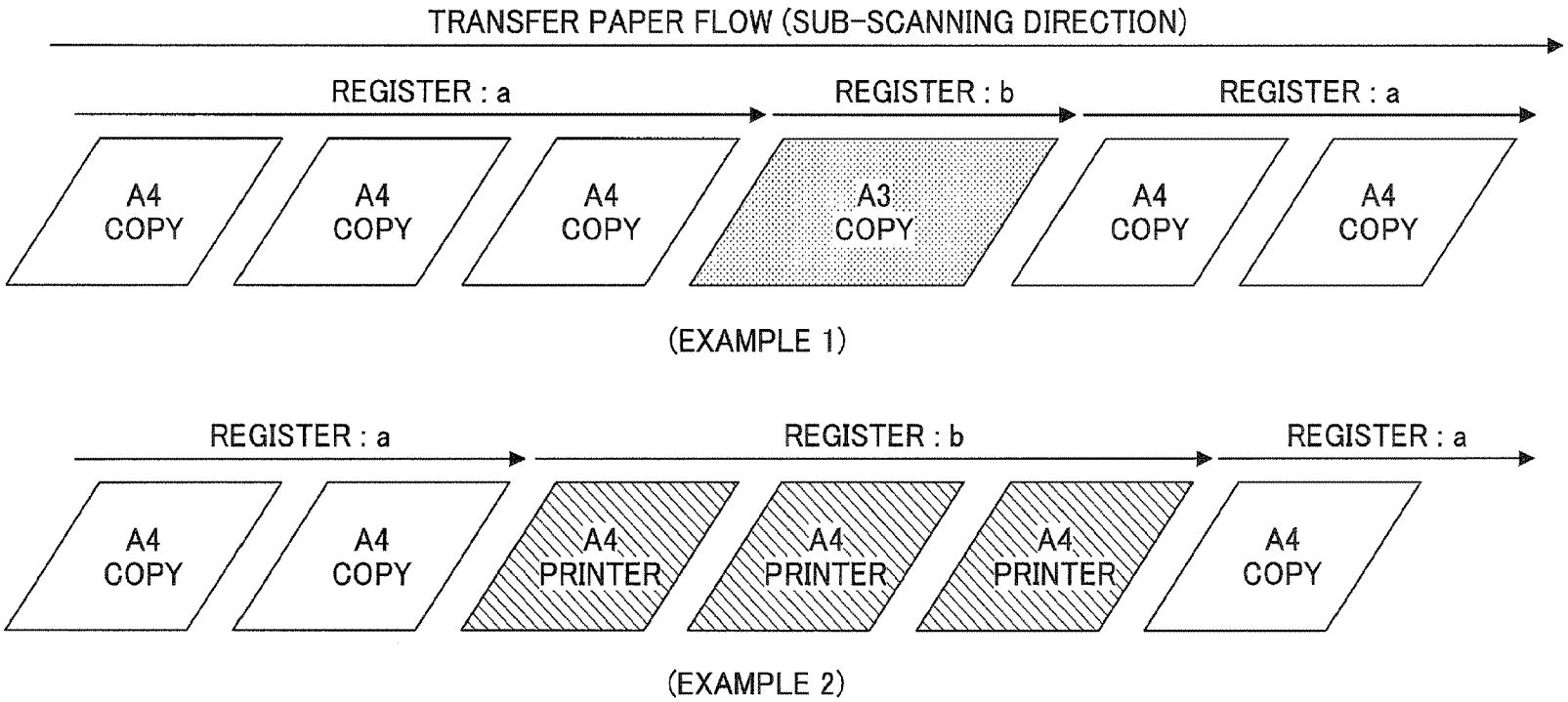
FIG. 15 is an illustration showing an example of parameter settings according to a conventional double register system.

A register of a register group switching signal for a function unit which uses a double register system When there is a function unit which is controlled by a double register system as described referring to FIG. 15 inside or outside of the plotter control unit 200, a switching signal can be set and transmitted for switching between registers a and registers b of the double register, thereby, even when there is a function unit using a double register, it is not necessary to perform severe timing control in order to realize a severe timing between pages.

There may be a case where the timing of switching between the registers a and the registers b is different from the timing of a normal printing operation or an adjustment pattern forming operation. Therefore, the LTSYNC assert timing is adjusted so that the timing of the switching signal of the registers a and the registers b becomes a required timing.

A hardware configuration for realizing the LTSYNC latch system will be described referring to FIG. 11 and FIG. 12.

Figure 11:
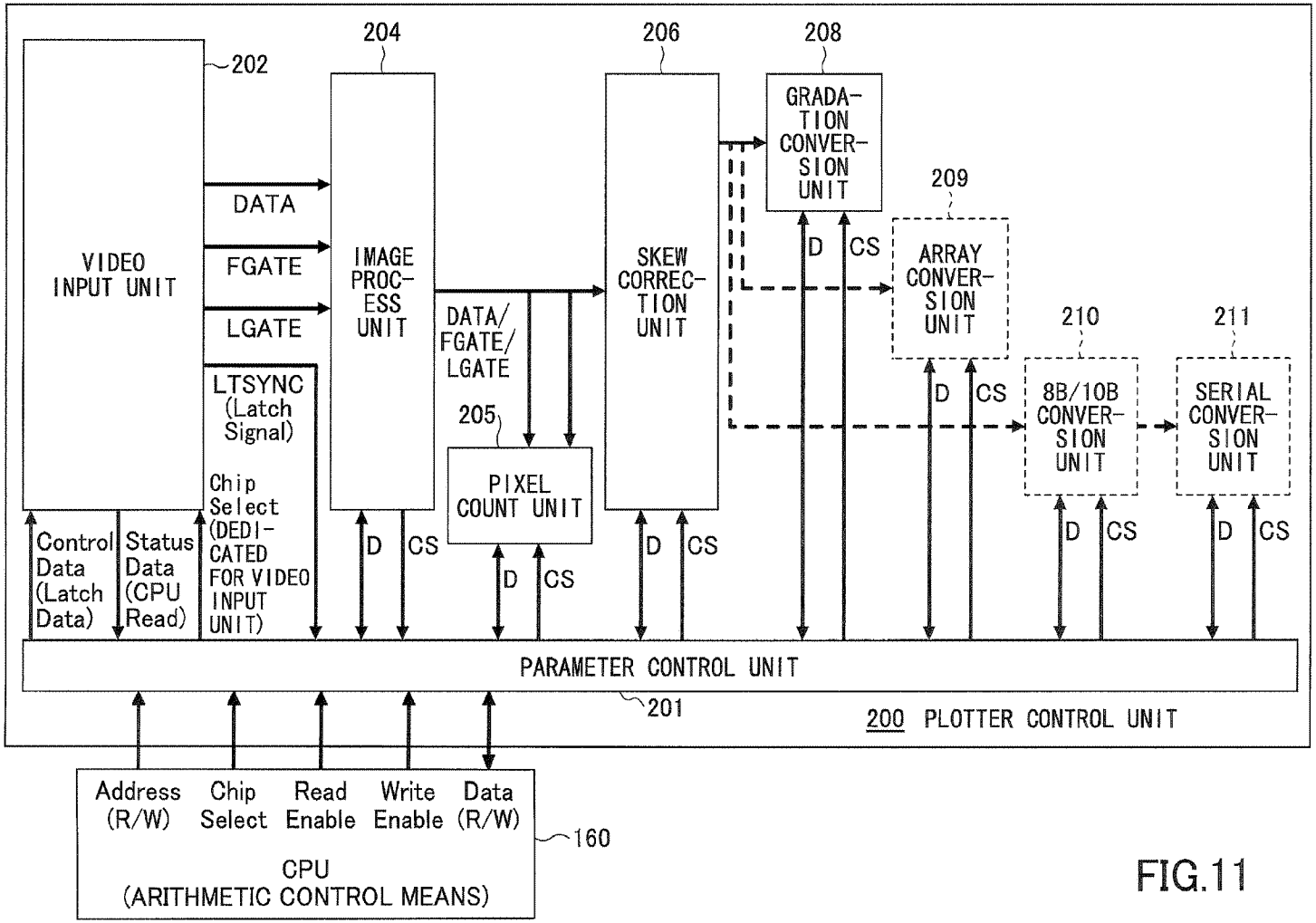
FIG. 11 is a block diagram illustrating a data and signal flow in the CPU 160 and the plotter control unit 200 shown in FIG. 1.

FIG. 11 is a block diagram illustrating a data and signal flow in the CPU 160 and the plotter control unit 200 shown in FIG. 1. FIG. 12 is a block diagram illustrating a storage example of parameter setting values according to the LTSYNC latch system in the parameter control unit 201 in FIG. 11.

In these figures, the same number or the same signal name is used for units corresponding to units in FIG. 1, FIG. 7 and FIG. 8, and the descriptions thereof are omitted.

As shown in FIG. 11, the CPU 160 includes a dedicated chip select signal for the process-function units in the plotter control unit 200, and selects the process-function units through the parameter control unit 201 using ON/OFF of the chip select signal.

The video input unit 202, the image process unit 204, the pixel count unit 205, the skew correction unit 206, and the gradation conversion unit 208 in the plotter control unit 200 are connected to the parameter control unit 201 via at least a chip select signal line and a data line. Further, if necessary, the array conversion unit 209, the 8B/10B conversion unit 210, and the serial conversion unit 211 are also connected to the parameter control unit 201. These units connected to the parameter control unit 201 are the process-function units.

Also, in the video input unit 202, the above-described latch synchronization signal LTSYNC, which asserts with a set time delay with respect to the frame synchronization signal MFSYNC, is input to the parameter control unit 201.

Configurations and functions of the video input unit 202 are almost the same as described referring to FIG. 7, but as described above, the timing control unit 2021 also generates the latch synchronization signal LTSYNC which asserts with a variable set time delay with respect to the frame synchronization signal MFSYNC.

Figure 12:
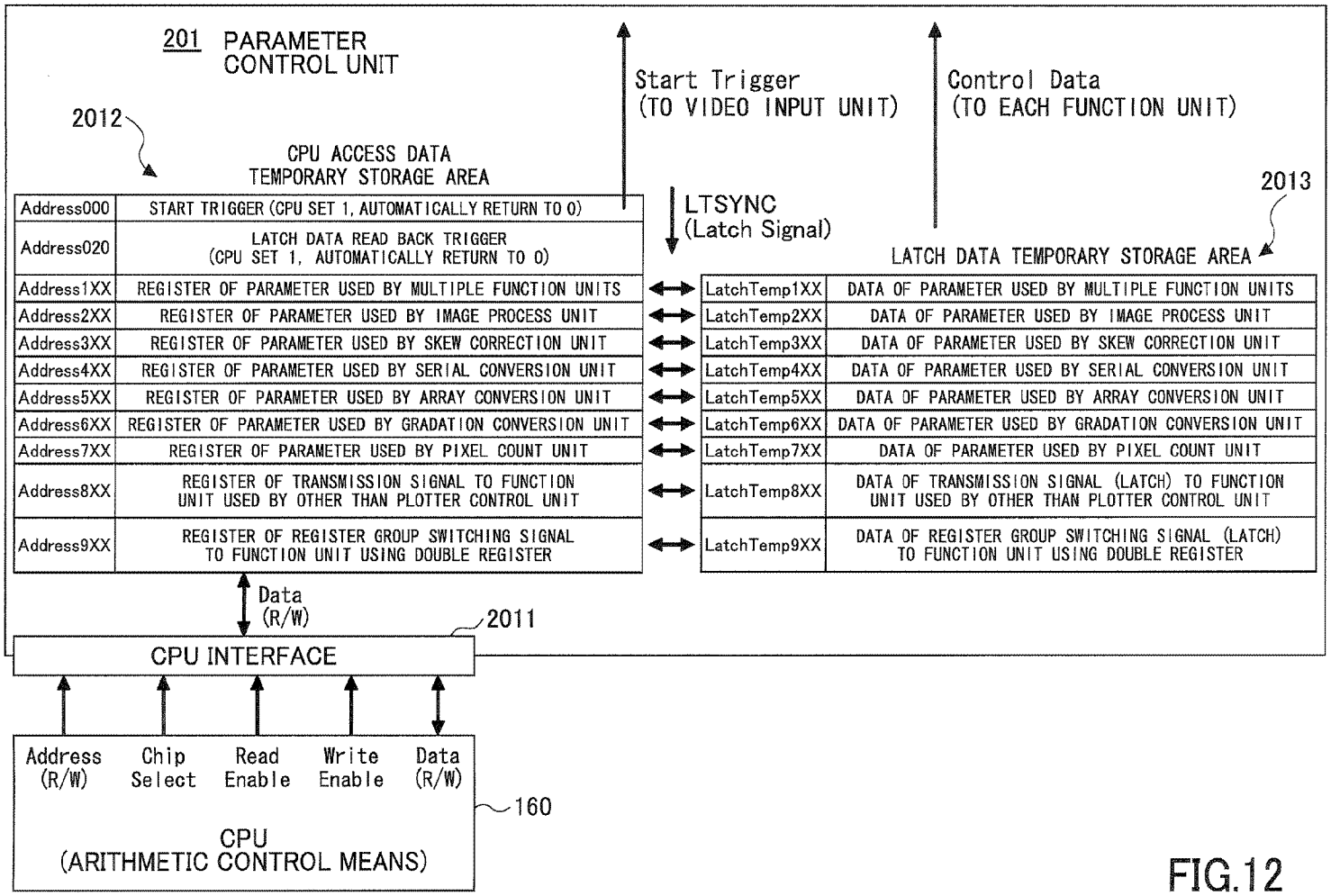
FIG. 12 is a block diagram illustrating a storage example of parameter setting values according to the LTSYNC latch system in the parameter control unit 201 in FIG. 11.

The CPU access data temporary storage area 2012 as the first storage means according to a memory in the parameter control unit 201 shown in FIG. 12 includes, in this example, storage areas (registers) of address000, 020, 1XX-9XX. The CPU 160 can directly access these registers, and write and read data.

Address000 is a start trigger register. When the CPU 160 sets "1" in this register, the start trigger signal asserts and the signal is transmitted to the timing control unit 2021 of the video input unit 202 described above. Immediately after this, the register automatically returns to "0". This operation is the same as the address00 in the CPU access data temporary storage area 2012 in FIG. 8.

Address 020 is a register for the latch data read back trigger. The CPU 160 sets "1" in the register when necessary. Afterwards, the register automatically returns to "0". When "1" is set in the latch data read back trigger register, data in the latch data temporary storage area 2013 are overwritten into (read back to) the CPU access data temporary storage area 2012, and thereby the data can be referred to from the CPU 160. This may be referred to as "the third storage means".

Registers of address1XX-9XX are target registers of the LTSYNC latch shown in FIG. 10, that is, the following registers.

- A register of a parameter used in a plurality of the function units
- A register of a parameter used in the image process unit 204
- A register of a parameter used in the skew correction unit 206
- A register of a parameter used in the serial conversion unit 211
- A register of a parameter used in the array conversion unit 209
- A register of a parameter used in the gradation conversion unit 208
- A register of a parameter used in the pixel count unit 205
- A transmission signal for a function unit used outside of the plotter control unit 200
- A register group switching signal for a function unit which uses a double register These registers are used for temporarily storing one page worth of setting values (data/information) of various parameters used by the various process-function units in the plotter control unit 200 according to the CPU 160's control.

After the start trigger signal is transmitted from the parameter control unit 201 to the video input unit 202, the latch synchronization signal LTSYNC is input from the video input unit 202 to the parameter control unit 201. According to the assert timing of the latch synchronization signal LTSYNC, the setting data stored in the registers of address1XX-9XX of the CPU access data temporary storage area 2012 are overwritten (copied) to and stored in the LatchTemp1XX-9XX of the latch data temporary storage area 2013. This operation is referred to as "latch".

The setting values of the various parameters which are temporarily stored in the LatchTemp1XX-9XX of the latch data temporary storage area 2013 are read out by various process-function units inside or outside of the video input unit 200 which is controlled by the CPU 160, and are reflected in the image formation process of the page.

Also in this LTSYNC latch system, it is necessary for the CPU access data temporary storage area 2012 and the latch data temporary storage area 2013 to hold only one page worth of the setting values of the parameters because the setting values are controlled on a color and page basis.

Also, the latch ON/OFF of the registers of the CPU access data temporary storage area 2012 can be switched. The initial value of the latch ON/OFF is ON (enabled). When the latch setting is OFF (disabled), values set by the CPU 160 are reflected in real time in the image formation operation of the video input unit 202.

At the time of a fatal error, because the latest setting values become effective in the next image forming process, only normal register setting is needed for the registers of the CPU access data temporary storage area 2012 at the recovery.

However, when image writing is interrupted due to a paper jam or machine trouble while printing, setting values of the registers of the CPU access data temporary storage area 2012 may be different from the data stored in the latch data temporary storage area 2013 which are reflected in the image forming process. As a result, an operation analysis at the time of image writing interruption is difficult. Therefore, there is a function in which "1" is set in the latch data read back trigger register, data in the latch data temporary storage area 2013 are overwritten (read back) to the CPU access data temporary storage area 2012, and thereby the data can be referred to from the CPU 160.

Types of registers of the CPU access data temporary storage area 2012 are not limited to the above-described examples, nor are the types of the setting data which are temporarily stored in the latch data temporary storage area 2013 which latch the setting data of the CPU access data temporary storage area 2012.

In the plotter control unit 200, it is possible to latch using a module which operates based on a clock (CLK_W) which is different from a clock (CLK_E) used by the video input unit 202 which generates the latch synchronization signal LTSYNC. For example, the latch may not be performed for each color but may be performed for each channel of an output optical system of a exposure means. In such a case, the latch is performed based on the latch synchronization signal LTSYNC of a version which is set by a register CHXSEL which defines the relation between the channel of the output optical system and the color. For example, let's assume CHXSEL=0h: 0 version, 1h: 1 version, 2h: 2 version, 3h: 3 version, 4h: 4 version, 5-7h: no operation.

There is a case where, after the image forming apparatus 100's power is turned ON, when creating an adjustment pattern without performing a print operation, image formation starts without asserting of the frame synchronization signal MFSYNC (IMFSYNC). In this case, because the latch synchronization signal LTSYNC is not automatically generated by the video input unit 202, it is better to have a function in which the CPU 160 causes the latch synchronization signal LTSYNC to assert without depending on the controller 150. This is referred to a LTSYNC manual assert.

After providing a LTSYNC manual assert setting register LTSYNCON, if "1" is set in the register, then during the time when "1" is set, the latch synchronization signal LTSYNC continues asserting. When LTSYNC continues asserting, the setting data of the registers of the CPU access data temporary storage area 2012 are latched to corresponding LatchTemp of the latch data temporary storage area 2013.

In order for the register LTSYNCON which causes the latch synchronization signal LTSYNC to assert to be latched, the period in which LTSYNCON keeps its value needs to be greater than two (2) clocks worth of the above-described clock CLK_E or CLK_W. About twenty (20) clocks worth of the clock CLK_E or CLK_W is needed in order for the CPU 160 to set the register LTSYNCON in an address. Therefore, there is no problem for the CPU 160 to perform the register write: register LTSYNCON 1->0: with no wait.

When the register LTSYNCON is "1", an operation of set parameters is "the same level of operation" as when the latch OFF setting is set. It should be noted that the latch OFF setting has a "higher priority".

In order for the CPU 160 to access two addresses (from start of setting 1 to end of setting 0), 10 clocks of CPU operation clock*2 is needed as a minimum. Normally, the CPU operation clock is a similar level of frequency as CLK_E or CLK_W.

Therefore, after setting (writing) 1, even if the CPU 160 performs writing 0 as soon as possible without considering wait time, the period in which LTSYNCON remains 1 is longer than the period necessary for the latch (two clocks of CLK_E or CLK_W); thus, there is no problem.

It should be noted that in a special system in which the CPU operation clock has a frequency much higher than CLK_E or CLK_W, after setting 1, it is necessary to wait for a time required for the latch before setting 0.

Also, when LTSYNCON is "1", not only the latch but also the reflection is performed at the same time. In other words, the parameters set by the CPU 160 are almost in real time reflected in the operations of process-function units, which is the same as a normal system. This is what is meant by the "the same level of operation".

Further, when the latch OFF setting is set, regardless whether LTSYNCON is "1" or "0", the parameters set by the CPU 160 are in real time reflected in the operations of the process-function units. This is what is meant by the "higher priority".

In addition to a group of registers of the CPU access data temporary storage area 2012, read-only addresses may be added, and by assigning the reflection values to the added addresses, a reflection value read system in which the CPU 160 directly reads the reflection values may be provided.

Also, as another reflection value read system, there may be a system in which, at the time of fatal error, automatically or according to instructions from the CPU 160, reflection values are overwritten into the original registers of the reflection values, and thereby the CPU 160 is capable of reading the reflection values.

This kind of reflection value read system can be provided in the case of the above-described MFSYNC latch system and the FLOAD latch system.

In the above-described LTSYNC latch system, timings of storing and reflecting parameter setting values can be automatically adjusted to be optimal timings when those parameter setting values are used by various process-function units; thereby, the period in which the CPU 160 sets the parameter values in the registers is maximized.

[Another Page Latch System]

Another page latch system in the write control apparatus according to the present invention will be described referring to FIG. 13 and FIG. 14.

Figure 13:
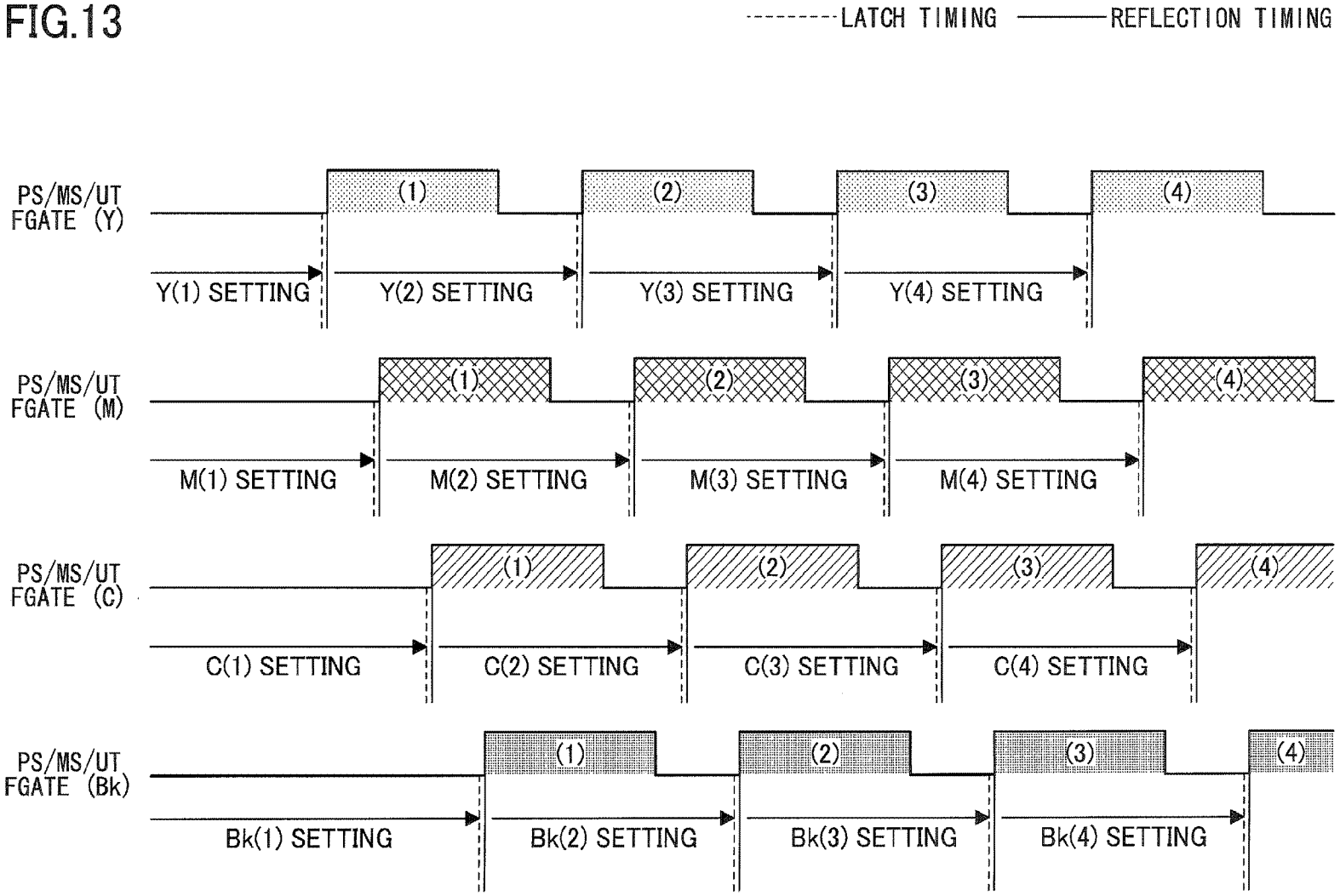
FIG. 13 is a timing diagram illustrating parameter setting and reflection timings by another latch system in the image forming apparatus shown in FIG. 1 and FIG. 2.

FIG. 13 is a timing diagram illustrating parameter setting and reflection timing by another latch system in the image forming apparatus shown in FIG. 1 and FIG. 2. FIG. 14 is an illustration showing an example of adjustment pattern latch parameters.

This page latch system is an adjustment pattern latch system. Therefore, parameter setting values of adjustment patterns of the pixel count unit 205 and the gradation conversion unit 208 in FIG. 1 are set in the CPU access data temporary storage area 2012 as the first storage means of the parameter control unit 201. Further, as shown in FIG. 13, just before an adjustment pattern signal FGATE asserts, setting values are latched and stored in the latch data temporary storage area 2013 as the second storage means. The setting values are, at the time when the adjustment pattern signal FGATE asserts, held by the pixel count unit 205 and the gradation conversion unit 208, and reflected in the image formation operation of the adjustment pattern. One pattern worth of the setting values for each color can be held.

The adjustment pattern signal FGATE has three types including a density adjustment pattern signal PSFGATE, a color matching adjustment pattern signal MSFGATE, and a prevent-blade-from-riding-up pattern (photoconductor total exposure pattern) signal UTFGATE. These adjustment pattern signals are generated by the image process unit 204 in the plotter control unit 200 in FIG. 1 without connecting with the controller 150.

There are two kinds of trigger signals for controlling the assert timing of the adjustment pattern signal FGATE.

The first kind of trigger signal is used in an operation in which the adjustment pattern signal FGATE automatically asserts after negating PFGATE_N signal for each color. The trigger signal is a STOUT signal, and "the second timing signal" as a latch signal is the above-described IMFSYNC signal.

The second kind of trigger signal is used in an operation in which the CPU 160, by using "adjustment pattern trigger register", uniquely controls the adjustment pattern signal FGATE to assert. If the adjustment pattern signal is the density adjustment pattern signal PSFGATE, then the "PSONFLG_R" for each color is controlled to assert.

If the adjustment pattern signal is the color matching pattern signal MSFGATE, then the "MSONFLG_R" for each color is controlled to assert. If the adjustment pattern signal is the prevent-blade-from-ridden-up pattern (photoconductor total exposure pattern) signal UTFGATE, then the "UTONFLG_R" for each color is controlled to assert.

If the CPU 160 sets 1 in the adjustment pattern trigger register, then until the CPU 160 sets 0, the FGATE signal for the adjustment pattern continues asserting. In the above-described cases, "the second timing signal" is each assert-edge of the "PSONFLG_R", "MSONFLG_R", and "UTONFLG_R".

These adjustment pattern signals PSFGATE/MSFGATE/UTFGATE are external signals connected to the CPU 160. The CPU 160 controls, for each pattern, a generation start timing, an end timing and a detection timing according to the timings of the adjustment pattern signals PSFGATE/MSFGATE/UTFGATE.

In FIG. 13, these adjustment pattern signals are represented by PS/MS/UTFGATE, and colors of yellow, magenta, cyan, and black are represented by (Y), (M), (C), and (Bk).

There is also a method in which external signals of adjustment pattern signals PSFGATE/MSFGATE/UTFGATE are not directly used, but assert edges and negate edges of the adjustment pattern signals PSFGATE/MSFGATE/UTFGATE are reflected in registers. In the above case, a register value change is used as an interrupt signal, which is monitored by the CPU 160.

Only one pattern worth of the parameter setting values related to the adjustment patterns needs to be held for each color.

Latch ON/OFF setting for the parameter setting registers related to the adjustment patterns can be switched. The initial value is ON (enabled). When the latch setting is OFF (disabled), values set by the CPU 160 are reflected in real time in the image formation operation by the pixel count unit 205 or the gradation conversion unit 208.

The latch control of the parameter setting registers related to the adjustment patterns can be performed independently for each process-function unit (each of the pixel count unit 205 and the gradation conversion unit 208), and the latch ON/OFF settings can be set individually.

Regarding the operation at the time of fatal error and the reflection value read system, these are the same as the above-described LTSYNC latch system.

FIG. 14 shows an example of adjustment pattern latch parameters.

Selection criteria of the target register of this adjustment pattern latch includes the following.

A register of setting adjustment patterns for setting a parameter used commonly for three kinds of adjustment patterns A register for setting a parameter used by the function units using the same circuit for controlling the images generated in the normal print and the adjustment patterns.

The example shown in FIG. 14 includes the following two registers as a target register.

A register of adjustment pattern control used in the pixel count unit 205:

start using the register in the operation according to output gate signals of the adjustment patterns generated by the image process unit 204. The pixel count function is basically the same for both the normal print and the adjustment pattern, but the weighting factor, the pixel counter maintenance, and the like need to be controlled individually. Operations are different for each color.

A register of adjustment pattern control used in the gradation conversion unit 208:

start using the register in the operation according to output gate signals of the adjustment patterns generated by the skew correction unit 206. The gradation conversion function is basically the same for both the normal print and the adjustment pattern, but the weighting factor, and the like need to be controlled individually. Setting values are not for each color, but for each circuit which operates for a corresponding channel of an output optical system of the exposure means.

The target registers of the adjustment pattern latch are not limited to the above examples.

In the adjustment pattern latch system, the timings of storing and reflecting parameters can be automatically adjusted to be optimal timings when those parameter setting values are used by the pixel count unit 205 and the gradation conversion unit 208; thereby, the period when the CPU 160 can set the parameters in the registers is maximized.

In the write control apparatus according to the present invention, it may not be desirable that only one of the above-described MFSYNC latch system, FLOAD latch system, LTSYNC latch system, and adjustment pattern latch system is provided. It may be desirable that a combination of the above-described systems may be provided. It may be most desirable to provide all of the above latch systems.

According to a write control apparatus of the above-described embodiment, by using registers controlled by addresses (first storage means), one page worth of setting values of various parameters for each color stored in the registers are stored in another storage area (second storage means) just before the start of image formation for each color.

Further, the stored parameter setting values are reflected in write control operations by the various process-function units in the write control unit at the image formation start timing of the page for each color.

Timings of storing and reflecting parameter setting values can be automatically adjusted to be optimal timings when those parameter setting values are used by various process-function units; thereby, the period in which the CPU 160 sets the parameter values in the registers is maximized.

In this way, while maintaining the productivity, the fast and reliable parameter setting for each page of the image formation can be realized by a simple system.

The present invention is a useful technique for the high speed image formation regardless of color or monochrome because severe timing control of parameter setting is needed in order to realize the high speed image formation.

In the above embodiment, a color image formation is given as an example because in the case of a color image, four colors worth of parameters need to be set for one page of image formation and the timings of parameter setting is more severe compared to a monochrome image and the present invention is especially useful for a color image.

Even in the monochrome image formation, in the case of a high-speed machine, the timing of parameter setting is more severe and the present invention is useful.

In the case of a dedicated monochrome image forming apparatus, only one channel is needed for the plotter control unit 200 as a write control unit. Therefore, only one set of the CPU access data temporary storage area 2012 as the first storage means and the latch data temporary storage area 2013 as the second storage means needs to be provided.

[Write Control Method]

In the write control method according to the present invention, a write control unit (plotter control unit 200) controlled by the above-described arithmetic control means (CPU 160) receives one page worth of image data and applies various processes using a plurality of different process-function units (video input unit 202, image process unit 204, and the like), and writes an image by exposing the photoconductor by controlling the exposure means according to the various-processes-applied image data. The write control method includes the following steps of (1) through (4).

(1) a step of, by the arithmetic control means (CPU 160), generating setting values of various parameters used in the plurality of process-function units, and storing the generated values in the first storage means (CPU access data temporary storage area 2012); (2) a step of, by the write control unit (plotter control unit 200), generating the second timing signal which asserts earlier than the first timing signal for operating the process-function units to start image writing;

(3) a step of, at the assert timing of the second timing signal, causing the second storage means (latch data temporary storage area 2013) to store one page worth of parameter setting values stored in the first storage means; and (4) a step of, by the write control unit (plotter control unit 200), reflecting the one page worth of setting values stored in the second storage means in operations of the process-function units for writing the image of the page. An embodiment of the write control method has been described sufficiently in the above-described embodiment of the write control apparatus of the image forming apparatus.

[Program]

A program according to the present invention causes the computer (CPU 160) which controls the above-described write control apparatus to perform the following steps (1)-(4). (1) a step of generating setting values of various parameters used by different process-function units (video input 202, image process unit 204, etc.,) and storing the setting values in a first storage means (CPU access data temporary storage area 2012);

(2) a step of causing the write control unit (plotter control unit 200) to generate the second timing signal which asserts earlier than the first timing signal for triggering an image write by operating the process-function units; (3) a step of, according to the assert timing of the second timing signal, storing one page worth of the setting values of the parameters stored in the first storage means in the second storage means (latch data temporary storage area 2013); and (4) a step of reflecting the one page worth of the setting values stored in the second storage means in operations of the process-function units for the image write of the current page.

The program may be stored beforehand in a program ROM which is included in the CPU (microcomputer) 160 as an arithmetic control means in the above-described embodiment. Alternatively, the program may be stored in a portable memory such as a CD-ROM and read by a computer of an image forming apparatus, or the program may be downloaded via a network.

The present invention is not limited to the above-described embodiments. The present invention may be applied to a monochrome image forming apparatus. In the case where the present invention is applied to a color image forming apparatus, an intermediate transfer drum may be used instead of an intermediate transfer belt, and a method in which a toner image of each color may be directly and sequentially in an overlapping manner transferred onto the recording medium (direct transfer method) may be used. The photoconductor is not limited to a drum type, but may be a belt type. The secondary transfer member is not limited to a belt type, but may be a drum type or a roller type. The types and the number of colors may be changed accordingly.

Also, the image forming apparatus to which the present invention is applied is not limited to a printer, but may be a print apparatus, a copy machine, a facsimile machine, or a multifunction peripheral which includes multiple functions thereof.

It should be noted that configurations and functions of the above embodiments may be appropriately added, changed, or partially omitted, and may be combined in any manner as long as they do not conflict with each other.

The present application is based on and claims the benefit of priority of Japanese Priority Application No. 2014-189011 filed on Sep. 17, 2014 with the Japanese Patent Office, the entire contents of which are hereby incorporated by reference.

What is claimed is:

1. A write control apparatus for receiving one page worth of image data, applying a plurality of processes, controlling an exposure unit according to the processes-applied image data, and writing an image by exposing a photoconductor, the write control apparatus comprising:

a write control unit configured to include different process-function units for applying the processes;

a computer configured to generate setting values of a plurality of parameters used by the process-function units and control the write control unit;

a first memory configured to store the setting values of the parameters generated by the computer; and a second memory configured to store one page worth of the setting values of the parameters stored in the first memory, wherein the write control unit includes a timing signal generation unit for generating a second timing signal which asserts earlier than a first timing signal which starts writing the image by operating the process-function units, wherein the second timing signal is a timing variable signal whose assert timing can be adjusted according to the setting values, the second memory latches and stores the one page worth of the setting values stored in the first memory according to an assert timing of the second timing signal, and the setting values stored in the second memory are reflected by the write control unit in operations of the process-function units for writing the image of the page.

2. The write control apparatus according to claim 1, wherein the setting values stored in the first memory and the second memory are setting values used in a tip of the page.

3. The write control apparatus according to claim 1, wherein the setting values stored in the first memory and the second memory are setting values that define an interface with a controller which sends the one page worth of the image data.

4. The write control apparatus according to claim 1, wherein the timing signal generation unit generates a plurality of the second timing signals at different timings, and the setting values stored in the first memory and the second memory include setting values which are latched from the first memory into the second memory at different timings according to the assert timings of the second timing signals.

5. The write control apparatus according to claim 4, wherein an assert timing of each timing variable signal can be adjusted according to the corresponding process-function unit.

6. The write control apparatus according to claim 1, wherein the setting values stored in the first memory and the second memory are setting values for a circuit which operates with a delay after an operation of a sub-scanning counter.

7. The write control apparatus according to claim 1, wherein the setting values stored in the first memory and the second memory are setting values for a circuit which operates for each channel of an output optical system of the exposure unit.

8. The write control apparatus according to claim 1, wherein the timing variable signal asserts after a set time elapses from an assert timing of a timing signal which instructs a controller which transmits one page worth of the image data to start the transmission.

9. The write control apparatus according to claim 1, wherein when writing the image is interrupted, the setting values which have been reflected in operations of the process-function units for the writing-interrupted image are stored back in the first memory from the second memory, and the stored-back setting values can be referred to by the computer.

10. The write control apparatus according to claim 1, wherein the write control unit, the first memory, and the second memory are provided for each of colors included in a color image.

11. An image forming apparatus including a write control apparatus according to claim 10 and a tandem type color image formation unit.

12. An image forming apparatus including a write control apparatus according to claim 1.

13. The write control apparatus according to claim 1, wherein when the latching is set to be disabled, the setting values stored in the first memory are reflected in real time in operations of the process-function units for writing the image of the page.

14. A write control method, performed by a write control unit which is controlled by a computer, for receiving one page worth of image data, applying a plurality of processes to the image data using different process-function units, controlling an exposure unit according to the processes-applied image data, and writing the image by exposing a photoconductor, the write control method comprising:

generating, by the computer, setting values of a plurality of parameters used by the process-function units and storing the generated setting values in a first memory;

generating, in the write control unit, a second timing signal which asserts earlier than a first timing signal which starts the writing of the image by operating the process-function units;

wherein the second timing signal is a timing variable signal whose assert timing can be adjusted according to the setting values, according to an assert timing of the second timing signal, storing and latching one page worth of the setting values stored in the first memory in a second memory; and reflecting the one page worth of the setting values stored in the second memory in operations of the process-function units for writing the image of the page.

15. A write control apparatus for receiving one page worth of image data, applying a plurality of processes, controlling an exposure means according to the processes-applied image data, and writing an image by exposing a photoconductor, the write control apparatus comprising:

write control means for including different process-function means for applying the processes;

arithmetic control means for generating setting values of a plurality of parameters used by the process-function means and controlling the write control means;

first storage means for storing the setting values of the parameters generated by the arithmetic control means; and second storage means for storing one page worth of the setting values of the parameters stored in the first storage means, wherein the write control means includes a timing signal generation means for generating a second timing signal which asserts earlier than a first timing signal which starts writing the image by operating the process-function means, wherein the second timing signal is a timing variable signal whose assert timing can be adjusted according to the setting values, the second storage means stores and latches the one page worth of the setting values stored in the first storage means according to an assert timing of the second timing signal, and the setting values stored in the second storage means are reflected by the write control means in operations of the process-function means for writing the image of the page.

* * * * *